US009377703B2

(12) United States Patent
Furukawa et al.

(10) Patent No.: US 9,377,703 B2
(45) Date of Patent: Jun. 28, 2016

(54) TONER FOR DEVELOPING ELECTROSTATIC LATENT IMAGE AND MANUFACTURING METHOD THEREOF

(71) Applicant: Konica Minolta, Inc., Tokyo (JP)

(72) Inventors: Junichi Furukawa, Hachioji (JP); Shiro Hirano, Hachioji (JP); Kenshi Miyajima, Hino (JP); Naoya Tonegawa, Sagamihara (JP); Asao Matsushima, Hino (JP); Tatsuya Nagase, Tachikawa (JP)

(73) Assignee: KONICA MINOLTA, INC., Tokyo (JP)

( * ) Notice: Subject to any disclaimer, the term of this patent is extended or adjusted under 35 U.S.C. 154(b) by 188 days.

(21) Appl. No.: 14/476,090

(22) Filed: Sep. 3, 2014

(65) Prior Publication Data

US 2015/0072285 A1 Mar. 12, 2015

(30) Foreign Application Priority Data

Sep. 6, 2013 (JP) ..... 2013-184901

(51) Int. Cl.
*G03G 9/08* (2006.01)
*G03G 9/087* (2006.01)

(52) U.S. Cl.
CPC ..... *G03G 9/0827* (2013.01); *G03G 9/0804* (2013.01); *G03G 9/0821* (2013.01); *G03G 9/0825* (2013.01); *G03G 9/08711* (2013.01); *G03G 9/08755* (2013.01)

(58) Field of Classification Search
CPC .. G03G 9/0827; G03G 9/0821; G03G 9/0825
USPC ..... 430/110.1, 110.3, 11.41
See application file for complete search history.

(56) References Cited

FOREIGN PATENT DOCUMENTS

| | | | |
|---|---|---|---|
| JP | 2011-095286 | A | 5/2011 |
| JP | 2012-163694 | A | 8/2012 |
| JP | 2013-033233 | A | 2/2013 |

*Primary Examiner* — Mark A Chapman
(74) *Attorney, Agent, or Firm* — Lucas & Mercanti, LLP

(57) ABSTRACT

According to one implementation, a toner includes a toner mother particle and a convex portion on a surface of the toner mother particle. The toner mother particle includes at least a resin (1). The convex portion is formed from a resin particle including at least a resin (2). An average value of a length of a long side of the convex portion is within a range of 0.1 to 0.5 μm. A ratio between a Young's modulus of a non-convex portion of the toner mother particle (ER (1)) and a Young's modulus of a convex portion of the toner mother particle (ER (2)) is a value (ER (1)/ER (2)) within the range of 1.2 to 2.0.

12 Claims, 2 Drawing Sheets

TONER FOR DEVELOPING ELECTROSTATIC LATENT IMAGE AND MANUFACTURING METHOD THEREOF

BACKGROUND

1. Field of the Invention

The present invention relates to a toner for developing an electrostatic latent image and a manufacturing method thereof. Specifically, the present invention relates to a toner for developing an electrostatic latent image and a manufacturing method thereof in which filming can be suppressed and low temperature fixing performance can be maintained while also being able to maintain fluidity.

2. Description of Related Art

Lately, in order to realize reduction of power consumption, increase of print speed, and widening the variety of types of paper that can be applied, a technique referred to as low temperature fixing which is a technique to fix toner images on a medium such as paper at a temperature lower than conventional techniques is gathering attention. Regarding toner, toner with a core shell structure made by providing a shell layer on the surface of a core particle is developed and by including styrene-acrylic type resin in the core particle and styrene-acrylic modified polyester resin in the shell layer, a toner (hereinafter referred to as "toner") for developing an electrostatic latent image with preferable low temperature fixing performance and fixing/separating performance can be obtained (for example, see Japanese Patent Application Laid-Open Publication No. 2013-33233).

With the fixing at low temperature and reduction of particle size of toner advancing, since the stirring strength in the developing device increased due to the increase of print speed, the mechanical stress that the developer receives by stirring has increased. Due to such mechanical stress, a phenomenon called "filming" occurs where a fragment of the toner particle or a component of the toner mother particle attaches to a photoreceptor or a surface of the carrier. When filming occurs and a large number of sheets are printed, defects in images could occur or applying the suitable charging amount to the toner could become difficult.

Therefore, the following toner is proposed where a convex portion is formed on a surface of the toner mother particle to make the contact area with other members small, hard fixing resistance with other members is maintained while maintaining low temperature fixing performance, and an image with high quality is formed (for example, see Japanese Patent Application Laid-Open Publication No. 2011-95286).

Also the following toner is reported where in order to prevent crushing of the convex portion due to mechanical stress, cross linked resin with a cross linked structure is used as the resin particle composing the convex portion (for example, see Japanese Patent Application Laid-Open Publication No. 2012-163694).

However, according to the technique described in Japanese Patent Application Laid-Open Publication No. 2011-95286 and Japanese Patent Application Laid-Open Publication No. 2012-163694, the hardness of the resin and the Young's modulus composing the convex portion is not considered. Therefore, there is a problem that the convex portion is buried in the toner mother particle due to mechanical stress and the filming is not suppressed sufficiently. Moreover, since styrene type resin is included as the resin composing the convex portion, there is a problem that the low temperature fixing performance is not enough.

Moreover, according to the technique of Japanese Patent Application Laid-Open Publication No. 2011-95286, there is a problem that the covering percentage of the convex portion is high, and the fluidity of the toner particle is not enough.

SUMMARY

The present invention has been made in consideration of the above problems, and it is one of main objects to provide a toner for developing an electrostatic latent image in which filming can be suppressed and low temperature fixing performance can be maintained while also being able to maintain fluidity and a manufacturing method of such toner.

In order to achieve at least one of the above-described objects, according to an aspect of the present invention, there is provided a toner for developing an electrostatic latent image including:

a toner mother particle; and a convex portion on a surface of the toner mother particle, wherein, (a) the toner mother particle includes at least a resin (1);

(b) the convex portion is formed from a resin particle including at least a resin (2);

(c) an average value of a length of a long side of the convex portion is within a range of 0.1 to 0.5 μm; and (d) a ratio between a Young's modulus of a non-convex portion of the toner mother particle (ER (1)) and a Young's modulus of a convex portion of the toner mother particle (ER (2)) is a value (ER (1)/ER (2)) within the range of 1.2 to 2.0.

Preferably, in the toner for developing an electrostatic latent image, the resin (2) is a resin including at least polyester resin.

Preferably, in the toner for developing an electrostatic latent image, the resin (2) is a resin formed from bonding a vinyl type polymerization segment and a polyester type polymerization segment.

Preferably, in the toner for developing an electrostatic latent image, a content ratio of the vinyl type polymerization segment in the resin (2) with respect to a total mass of the resin formed from bonding the vinyl type polymerization segment and the polyester type polymerization segment is within a range of 1 to 30% by mass.

Preferably, in the toner for developing an electrostatic latent image, a content ratio of the vinyl type polymerization segment in the resin (2) with respect to a total mass of the resin formed from bonding the vinyl type polymerization segment and the polyester type polymerization segment is within a range of 5 to 10% by mass.

Preferably, in the toner for developing an electrostatic latent image, a covering percentage of the convex portion with respect to a certain surface area of the toner mother particle is within a range of 5 to 25%.

Preferably, in the toner for developing an electrostatic latent image, a covering percentage of the convex portion with respect to a certain surface area of the toner mother particle is within a range of 10 to 20%.

Preferably, in the toner for developing an electrostatic latent image, the resin (1) is a resin including at least styrene-acrylic type resin.

Preferably, in the toner for developing an electrostatic latent image, an average particle diameter of the resin particle including at least the resin (2) is within a range of 50 to 500 nm.

BRIEF DESCRIPTION OF THE DRAWINGS

The present invention will become more fully understood from the detailed description given hereinbelow and the appended drawings, and thus are not intended to define the limits of the present invention, and wherein.

DETAILED DESCRIPTION OF PREFERRED EMBODIMENTS

Figure 1:
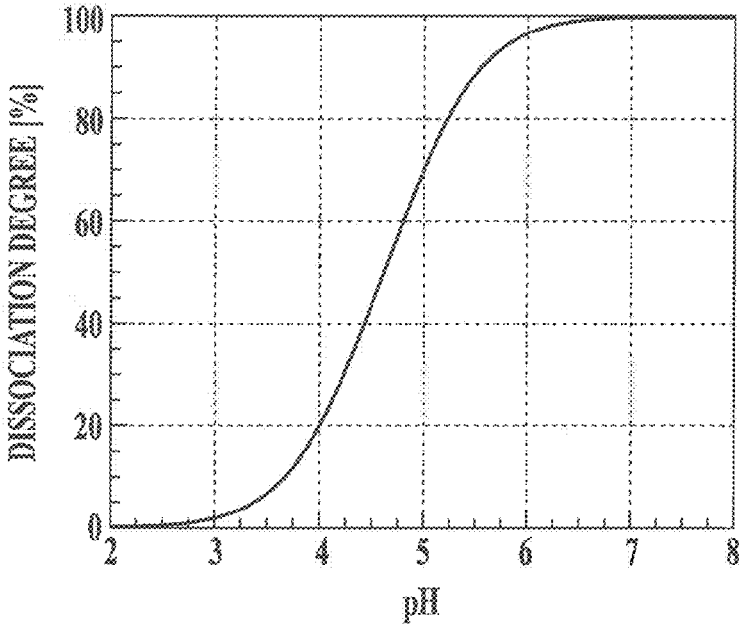
FIG. 1 is a graph showing dissociation degree of a carboxy group on a surface of a toner mother particle with respect to pH.

According to the present invention, a toner for developing an electrostatic latent image includes:

a toner mother particle; and a convex portion on a surface of the toner mother particle, wherein, (a) the toner mother particle includes at least a resin (1);

(b) the convex portion is formed from a resin particle including at least a resin (2);

(c) an average value of a length of a long side of the convex portion is within a range of 0.1 to 0.5 μm; and (d) a ratio between a Young's modulus of a non-convex portion of the toner mother particle (ER (1)) and a Young's modulus of a convex portion of the toner mother particle (ER (2)) is a value (ER (1)/ER (2)) within the range of 1.2 to 2.0.

This is a common technical feature of the scope of the claims of the present invention.

According to the present invention, it is possible to provide a toner for developing an electrostatic latent image in which filming can be suppressed and low temperature fixing performance can be maintained while also being able to maintain fluidity and a manufacturing method of such toner.

The mechanism of the effects of the present invention is not clear, but it is assumed to be as follows.

By using a resin (2) with a low Young's modulus as a resin particle which forms a convex portion, the convex portion functions like a cushion material, and cases where the convex portion is buried in the toner mother particle due to mechanical stress from stirring in the developer become less. Therefore, it is assumed that the uneven shape of the surface of the toner mother particle is maintained. It is also assumed that since the convex portion functions like a cushion material, less toner is attached to the carrier or photoreceptor. Since the resin (2) with a low Young's modulus is used as the resin to form the convex portion, the toner particle is attached to media such as paper even if the covering percentage is low, and with this, low temperature fixing performance can be maintained. Further, since the covering percentage of the convex portion is low, the surface smoothness is not worsened, and the toner of the present invention is able to maintain fluidity.

Preferably, according to the present invention, the resin (2) is a resin including at least polyester resin. With this, the low temperature fixing performance and the fixing/separating performance can be enhanced.

Preferably, according to the present invention, the resin (2) is a resin formed from bonding a vinyl type polymerization segment and a polyester type polymerization segment (hereinafter also referred to as "vinyl modified polyester resin"). With this, the following effect can be achieved, filming can be suppressed and low temperature fixing performance can be maintained while also being able to maintain fluidity.

Preferably, according to the present invention, a content ratio of the vinyl type polymerization segment in the resin (2) with respect to a total mass of the resin formed from bonding the vinyl type polymerization segment and the polyester type polymerization segment is within a range of 1 to 30% by mass. With this, the following effect can be achieved, filming can be suppressed and low temperature fixing performance can be maintained.

Preferably, according to the present invention a content ratio of the vinyl type polymerization segment in the resin (2) with respect to a total mass of the resin formed from bonding the vinyl type polymerization segment and the polyester type polymerization segment is within a range of 5 to 10% by mass. With this, the following effect can be achieved, filming can be suppressed and low temperature fixing performance can be maintained.

Preferably, according to the present invention, a covering percentage of the convex portion with respect to a certain surface area of the toner mother particle is within a range of 5 to 25%. With this, the following effect can be achieved, filming can be suppressed and low temperature fixing performance can be maintained while also being able to maintain fluidity.

Preferably, according to the present invention, the resin (1) is a resin including at least styrene-acrylic type resin. With this, it is possible to achieve the effect of being able to suppress filming.

Preferably, a manufacturing method of the toner for developing an electrostatic latent image of the present invention includes at least the above steps (1) to (4). With this, the toner for developing an electrostatic image in which filming can be suppressed and low temperature fixing performance can be maintained while also being able to maintain fluidity can be manufactured.

Preferably, in a manufacturing method of the toner for developing an electrostatic latent image of the present invention, forming the toner mother particle (step (4)) includes adjusting pH of the aqueous medium with a pH adjuster after attaching the resin (2) to the toner mother particle precursor. With this, the following effect can be achieved, the length of the long side of the convex portion and the covering percentage can be suitably set.

The present invention and its elements, and embodiments of the present invention are described in detail below. When a range of values is shown, the minimum value and the maximum value are included.

(Outline of Toner for Developing Electrostatic Latent Image of the Present Invention)

According to the present invention, a toner for developing an electrostatic latent image includes:

a toner mother particle; and a convex portion on a surface of the toner mother particle, wherein, (a) the toner mother particle includes at least a resin (1);

(b) the convex portion is formed from a resin particle including at least a resin (2);

(c) an average value of a length of a long side of the convex portion is within a range of 0.1 to 0.5 μm; and (d) a ratio between a Young's modulus of a non-convex portion of the toner mother particle (ER (1)) and a Young's modulus of a convex portion of the toner mother particle (ER (2)) is a value (ER (1)/ER (2)) within the range of 1.2 to 2.0.

<Toner Mother Particle>

The toner for developing electrostatic latent image according to the present invention includes a toner mother particle including a convex portion on a surface, and the toner mother particle includes at least the resin (1).

Here, the basic portion other than the convex portion of the toner mother particle of the present invention is called "non-convex portion".

Any well-known toner mother particle can be used as the toner mother particle of the present invention.

Such non-convex portion of the toner mother particle specifically includes at least the resin (1) (hereinafter also referred to as "binding resin") and the toner mother particle including colorant as necessary. Moreover, the toner mother particle can include other components such as mold release agent and charge control agent as necessary.

Preferably, a particle diameter of the toner mother particle is within the range of 3 to 10 μm in a volumetric basis median diameter ($D_{50}$% diameter). This is preferable because it is possible to obtain highly fine images if the value is within the above range.

(Resin (1))

Preferably, the thermoplastic resin is used as resin (1)

As resin (1), resin which is typically used as binding resin composing toner can be used without limits. Specifically, examples of such resin are, styrene type resin, acrylic type resin such as alkyl acrylate and alkyl methacrylate, styrene-acrylic type resin, polyester resin, silicone resin, olefin type resin, amide resin, and epoxy resin. The above resin can be used alone or by combining two or more types of resin.

Preferably, the resin (1) at least included in the toner mother particle of the present invention is a styrene-acrylic type resin in which a styrene type monomer and an acrylic type monomer is polymerized. With this, it is possible to obtain the effect of further suppressing filming.

Preferably, the polymerizable monomer used in the styrene-acrylic type resin is an aromatic type vinyl monomer and a (meth)acrylic acid ester type monomer, and includes ethylene unsaturated bonding body in which radical polymerization is possible. For example, styrene, o-methyl styrene, m-methyl styrene, p-methyl styrene, p-methoxy styrene, p-phenyl styrene, p-chloro styrene, p-ethyl styrene, p-n-butyl styrene, p-tert-butyl styrene, p-n-hexyl styrene, p-n-octyl styrene, p-n-nonyl styrene, p-n-decyl styrene, p-n-dodecyl styrene, 2,4-dimethyl styrene, 3,4-dichloro styrene and derivatives thereof. Such aromatic type vinyl monomer can be used alone or by combining two or more types.

The following can be used as (meth)acrylic acid ester type monomer, for example, methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, β-hydroxy ethyl acrylate, γ-amino propyl acrylate, stearyl methacrylate, dimethylaminoethyl methacrylate, and diethylaminoethyl methacrylate. Such (meth)acrylic acid ester type monomer can be used alone or by combining two or more types. Preferably, among the above, the styrene type monomer and the acrylic ester type monomer or the methacrylic acid ester type monomer are combined and used.

As the polymerizable monomer, the third vinyl type monomer can be used. The following can be used as the third vinyl type monomer, for example, acid monomer such as acrylic acid, methacrylic acid, maleic acid anhydride, and vinyl acetic acid, acrylamide, methacrylamide, acrylonitrile, ethylene, propylene, butylene vinyl chloride, N-vinyl pyrrolidone, butadiene and the like.

As the polymerizable monomer, a multifunctional vinyl type monomer can also be used. The following can be used as the multifunctional vinyl type monomer, for example, diacrylate such as ethylene glycol, propylene glycol, butylene glycol, hexylene glycol, etc., divinylbenzene, pentaerythritol, dimethacrylate and trimethacrylate with alcohol of tertiary or more such as trimethylolpropane, etc., and the like. The copolymerization ratio of multifunctional vinyl type monomer with respect to the entire polymerizable monomer is usually within the range of 0.001 to 5% by mass, preferably within the range of 0.003 to 2% by mass, and more preferably within the range of 0.01 to 1% by mass. By using the multifunctional vinyl type monomer, an insoluble gel component is generated in tetrahydrofuran, but the percentage that the gel component accounts for with respect to the entire monomer is usually equal to or less than 40% by mass, and preferably equal to or less than 20% by mass.

Preferably, glass transition temperature (Tg) of the resin (1) is within the range of 40 to 60° C.

Moreover, softening temperature of the resin (1) is preferably within the range of 80 to 130° C.

(Glass Transition Temperature (Tg) Measuring Method)

The glass transition temperature of the resin (1) is a value measured by the method (DSC method) defined by ASTM (American Society for Testing and Materials) D3418-82.

Specifically, 3.0 mg of a sample is weighed precisely to two digits after the decimal, the sample is sealed in an aluminum pan, and the sample is set in a sample holder of a differential scanning calorimeter "Diamond DSC" (manufactured by PerkinElmer, Inc.). An empty aluminum pan is used for reference, temperature is controlled by raising-lowering-raising at a measured temperature being within a range of 0 to 200° C., temperature raising speed being 10° C. per minute, temperature lowering speed being 10° C., and the analysis is performed based on data when the temperature is raised the second time. The glass transition temperature is to be the value of the crossing point between the extended line of the base line before the rising of the first endothermic peak and the tangent showing the maximum slope from the rising portion of the first endothermic peak to the top of the peak.

(Softening Temperature (Tsp) Measuring Method)

The softening temperature (Tsp) of the resin (1) is measured by the following method.

First, under an environment of 20° C.±1° C., 50%±5% RH, 1.1 g of resin is placed in a petri dish and smoothed to be flat. After leaving the resin as is for 12 hours or more, pressure is applied for 30 seconds at a force of 3820 kg/cm$^2$ by a molder "SSP-10A" (manufactured by Shimadzu Corporation), and a cylinder shaped molded sample with a 1 cm diameter is made. Next, under the environment of 24° C.±5° C., 50%±20% RH, using a flow tester "CFT-500D" (manufactured by Shimadzu Corporation) under the conditions of load 196 N (20 kgf), starting temperature 60° C., preheat time 300 seconds, temperature raising speed 6° C. per minute, the molded sample is pressed out from a hole of a cylinder shaped die (1 mm diameter×1 mm) using a piston with a diameter of 1 cm after finishing the preheating. The softening temperature of the resin is to be an offset method temperature $T_{offset}$ measured at a setting of 5 mm off set value with melting temperature measuring method of raising temperature method.

<Method of Manufacturing Resin (1)>

Preferably, the resin (1) of the present invention is prepared by emulsion polymerization. Emulsion polymerization can be obtained by dispersing and polymerizing in an aqueous medium polymerizable monomers such as styrene, acrylic acid ester, and the like.

Preferably, a surfactant is used to disperse the polymerizable monomers in the aqueous medium. A polymerization initiator or a chain transfer agent can be used for polymerization.

(Polymerization Initiator)

The polymerization initiators used in the polymerization of the resin (1) is not limited and any well-known polymerization initiator can be used. Specifically, examples include the following, peroxides such as hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, ammonium persulfate, sodium persulfate, potassium persulfate, diisopropyl peroxycarbonate, tetralin hydroperoxide, 1-phenyl-2-methylpropyl-1-hydroperoxide, tert-hydroperoxide petriphenylacetate, tert-butyl performate, tert-butyl peracetate, tert-butyl-perbenzoate, tert-butyl perphenylacetate, tert-butyl permethoxyacetate, and tert-butyl per-N-(3-toluoyl)palmitate; and azo compounds such as 2,2'-azobis(2-aminodipropane)hydrochloride, 2,2'-azobis(2-aminodipropane)nitrate, 1,1'-azobis(1-methylbutyronitrile-3-sodium sulfonate), 4,4'-azobis-4-cyanovaleric acid, and poly(tetraethylene glycol-2,2'-azobisisobutyrate); and the like. The added amount of the polymerization initiator is different depending on the desired molecular weight and molecular weight distribution. Preferably, specifically, the polymerization initiator is added within the range of 0.1 to 5.0% by mass with respect to the polymerizable monomer.

(Chain Transfer Agent)

In manufacturing the resin (1) of the present invention, the chain transfer agent can be added together with the polymerization monomer. The molecular weight of the polymer can be controlled by adding the chain transfer agent. In the above described step of polymerizing aromatic type vinyl monomer and a (meth)acrylic acid ester type monomer, it is possible to use a typically used chain transfer agent for the purpose of adjusting the molecular weight of the styrene-acrylic type polymer segment. The chain transfer agent is not limited and the following can be used, for example, alkyl mercaptan, mercapto fatty acid ester or the like.

The added amount of the chain transfer agent is different depending on the desired molecular weight and molecular weight distribution. Preferably, specifically, the chain transfer agent is added within the range of 0.1 to 5.0% by mass with respect to the polymerizable monomer.

(Surfactant)

When the emulsion polymerization method is used and the resin (1) is dispersed in the aqueous medium and polymerized, a dispersion stabilizer is usually added to prevent aggregation of dispersed drops. Any well-known surfactant can be used as the dispersion stabilizer, and the dispersion stabilizer selected from a group of cationic surfactant, anionic surfactant, and non-ionic surfactant can be used. A combination of two or more of the above surfactants can be used. The dispersion stabilizer can be used in the dispersion liquid of colorant, offset preventing agent, etc.

Specific examples of cationic surfactant include, dodecyl ammonium bromide, dodecyl trimethyl ammonium bromide, dodecyl pyridinium chloride, dodecyl pyridinium bromide, hexadecyl trimethyl ammonium bromide, and the like.

Specific examples of non-ionic surfactant include, dodecyl polyoxy ethylene ether, hexadecyl polyoxy ethylene ether, nolylphenyl polyoxy ethylene ether, lauryl polyoxy ethylene ether, sorbitan monooleate polyoxy ethylene ether, styryl phenyl polyoxy ethylene ether, monodecanoyl sucrose, and the like.

Specific examples of anionic surfactant include, aliphatic type soap such as sodium stearate, sodium laurate, etc., sodium lauryl sulfate, sodium dodecyl benzene sulfonate, and polyoxy ethylene (2) sodium lauryl ether sulfate and the like.

<Convex Portion of Toner Mother Particle>

The toner for developing an electrostatic latent image of the present invention includes a convex portion formed by a resin particle including at least resin (2) (hereinafter also referred to as "resin (2) particle").

According to the present invention, the average length of the long side of the convex portion is within the range of 0.1 to 0.5 μm. With this, according to the toner for developing an electrostatic latent image of the present invention, it is possible to achieve the effects of being able to suppress filming and being able to maintain fluidity while maintaining low temperature fixing performance.

In the present invention, in order to make the low temperature fixing performance and the fixing/separating performance to be good, it is preferable that the resin (2) is a resin including at least polyester. The resin (2) is described in detail later.

In the present invention, it is preferable that the covering percentage of the convex portion is within the range of 5 to 25% with respect to a certain surface area of the toner mother particle, and it is more preferable that the percentage is within the range of 10 to 20%.

When the covering percentage of the convex portion is 5% or more, it is possible to avoid the possibility of filming occurring and the low temperature fixing performance becoming worse. When the covering percentage is 25% or less, it is possible to avoid the possibility of the resin fine particle being buried in the toner mother particle and the fluidity becoming worse. Therefore, when the covering percentage of the convex portion is within the range of 5 to 25% with respect to the certain surface area of the toner mother particle, it is possible to obtain the effect of being able to suppress filming and being able to maintain fluidity while maintaining low temperature fixing performance.

(Forming of Convex Portion)

The method of forming the convex portion of the present invention is not limited, and can be any method which is able to form the convex portion on the surface of the toner mother particle.

For example, the later described step (4) shows the following method. In the aqueous medium where the toner mother particle precursor, in which the resin (1) particle is aggregated, and the resin (2) particle are dispersed, after the pH is adjusted, the above is heated and stirred in a state within the range of 75 to 90° C. With this, the resin (2) particle is fused to the surface of the toner mother particle precursor and the convex portion is formed.

Here, the mechanism of the method of forming the convex portion by fusing the resin (2) particle on the surface of the toner mother particle precursor in the aqueous medium is described in detail.

A $pK_a$ value ($pK_a$=4.7) obtained by measuring surface acid content of the resin (2) particle is assigned to the Henderson-Hasselbalch equation showing a relation between hydrogen-ion concentration and acidity, and the dissociation degree of the carboxy group with respect to the pH of the aqueous medium is studied. It is found that the dissociation amount of the carboxy group of the surface of the resin (1) particle and the resin (2) particle changes between pH 2 to 8 (measured at liquid temperature 80° C.) (see FIG. 1). The dissociated carboxy group forms an ionic bond through an aggregation agent (for example, magnesium ion). Therefore, the pH of the aqueous medium at fusing can be adjusted to control the ion bonding amount between the carboxy group and the aggregation agent. It is assumed that when the amount of ion bonding of the interface between the toner mother particle precursor and the resin (2) particle in fusing is small, compatibility progresses by the molecular chain of the resin composing the particle entering each other and the surface of the toner particle is smoothed. On the other hand, it is assumed that when the amount of ion bonding in the interface is large, the molecular chain is fixed which make movement difficult, and therefore, the compatibility is suppressed and the convex portion is formed. In other words, it is assumed that since it is difficult to form the convex portion when the pH of the aqueous medium in fusing is low, and the convex portion is easily formed when the pH is high, the compatibility can be controlled by changing the pH and the amount of convex portions formed can be changed. The amount and type of the polar group of the carboxy group, etc. which forms the ion bonding are different depending on the resin type. Therefore, the suitable range of pH to change the amount of convex portions formed may change.

(Measuring Average Value of Length of Long Side of Convex Portion)

Figure 2:
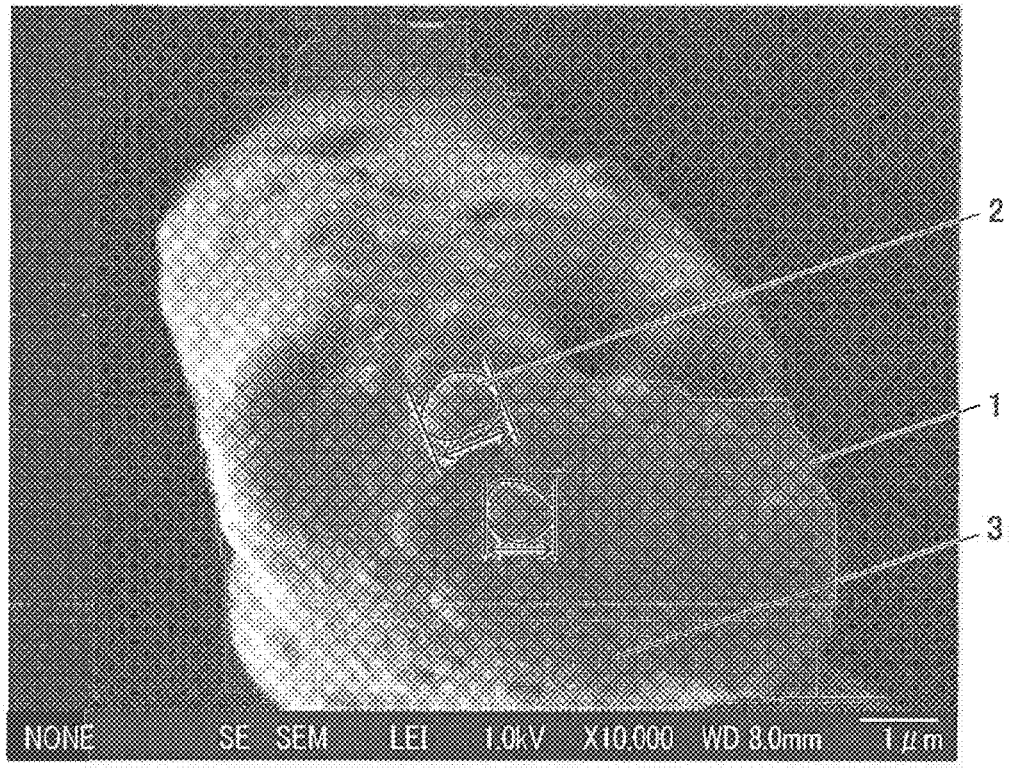
FIG. 2 is a diagram describing an average value of a length of a long side of a convex portion of the present invention.

The measurement of the average value of the length of the long side of the convex portion is described using FIG. 2. FIG. 2 is a diagram describing the average value of the length of the long side of the convex portion of the present invention, and shows an example of a toner mother particle 1 including a convex portion 2 and a non-convex portion 3 on the surface.

The long side of the convex portion 2 of the present invention is a portion as follows. When scanning electron microscope (SEM) image data multiplied 10000 times is observed under a scanning electron microscope (SEM), the convex portion 2 and the non-convex portion 3 are confirmed by sight. An outline is drawn for each convex portion 2, and two parallel lines are drawn with the outline in between. The portion where the distance between the two parallel lines is largest is to be the long side of the convex portion 2. In the measurement, 100 convex portions 2 which have a long side with a length of 50 nm or more are measured, and the average value of the above is to be the average value of the length of the long side of the convex portion 2 of the present invention.

(Measuring Covering Percentage of Convex Portion)

Figure 3:
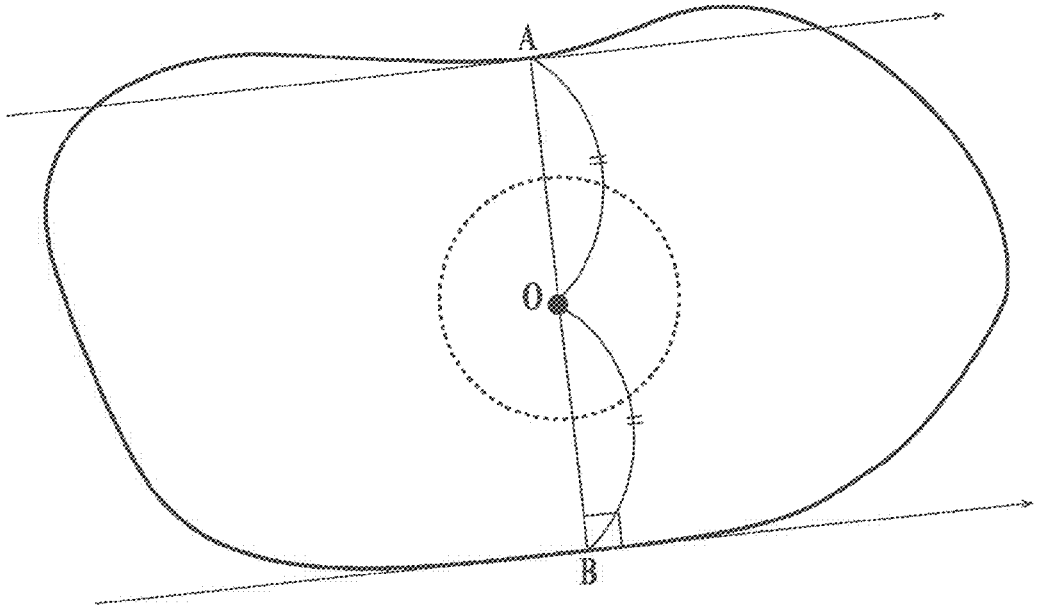
FIG. 3 is a diagram describing a covering percentage of the convex portion of the present invention.

The measurement of the covering percentage of the convex portion is described using FIG. 3. FIG. 3 is a diagram describing the covering percentage of the convex portion of the present invention.

The toner mother particle is observed under the scanning electron microscope (SEM), and the covering percentage of the convex portion with respect to a certain surface area of the toner mother particle is calculated from the obtained SEM image.

(1) The shortest length of the two parallel lines in contact with the toner mother particle is calculated, and each contact point is to be A and B.

(2) The area of the circle with a midpoint O of a line AB as the center and a length of AO as the diameter is to be the certain surface area, and the covering percentage of the convex portion with respect to the toner mother particle is calculated with the area of the convex portion included in the circle.

(3) The covering percentage is calculated by the above method for the 100 or more toner particles, the average value is obtained, and this is to be the covering percentage.

(Young's Modulus of Non-Convex Portion and Young's Modulus of Convex Portion in Toner Mother Particle)

According to the present invention, the value of the ratio (ER (1)/ER (2)) between the Young's modulus (ER (1)) of the non-convex portion and the Young's modulus (ER (2)) of the convex portion in the toner mother particle is within the range of 1.2 to 2.0. With this, it is possible to provide a toner for developing an electrostatic latent image in which it is possible to suppress filming and it is possible to maintain fluidity while maintaining fixing performance at low temperature.

(Measurement of Young's Modulus)

According to the present invention, the measurement of the Young's modulus is performed using the nanoindentation method.

The Young's modulus Er measured by the nanoindentation method is measured using a nanoindenter (micro-hardness tester), specifically, "Triboscope and SII NanoNavi II" (manufactured by Hysitron Corporation). Specifically, the applied load of the probe is changed from 0.1 μN to 30 μN in a unit of 0.3 μN, the measurement data is collected until the depth of indenting by the probe passes 100 nm and the Young's modulus Er of the outermost surface is calculated from the load curve when pressed to 100 nm. The depth of indenting the probe is not limited to 100 nm and can be a suitable depth judged to be the outermost surface.

The positions of the convex portion and the portion other than the convex portion (non-convex portion) on the surface of the toner mother particle is confirmed while watching the scanning probe microscope, and the measurement is done distinguishing the non-convex portion from the convex portion of the toner mother particle. Since the scanning probe microscope has a resolution of a few nm, the additive can also be distinguished.

For example, the specific measurement condition is as described below.

Measurement Indenter: diamond Berkovich indenter with an equilateral triangle shaped tip Measurement Environment: 20° C., 60% RH Measurement Sample: commercially available Araldite (epoxy which is a 12-hour hardening type) on a glass slide The adhesive is thinly applied, and after hardening at room temperature for 1.5 hours, the toner is sprinkled and further hardened. In a state where the bottom portion of the toner particle is fixed to the adhesive, the exposed portion of the surface is measured. The measurement is performed by measuring randomly selected 10 points for each sample, and the average value is to be the Young's modulus measured by the nanoindentation method. The Young's modulus (ER (1)) of the non-convex portion and the Young's modulus (ER (2)) of the convex portion in the toner mother particle are measured separately and the value of the ratio (ER (1)/ER (2)) of the Young's modulus of the present invention is calculated.

The Young's modulus of the resin can be controlled by changing the content ratio of the vinyl type polymerization segment of the vinyl modified polyester resin.

(Resin (2))

The resin (2) of the present invention is not limited and can be any well-known resin which can form the convex portion. Examples of such resin include, styrene type resin, acrylic type resin such as alkyl acrylate and alkyl methacrylate, styrene-acrylic type resin, polyester resin, silicone resin, olefin type resin, amide resin, epoxy resin, and the like. Such resin can be used alone or by combining two or more types.

Here, resin bonding (modifying) a component other than the polyester polymerization segment by a percentage of 50% by mass or less is considered to be polyester resin. Preferably, the other components is the vinyl type polymerization segment.

Among the above, resin including at least polyester resin is preferable because this enables good low temperature fixing performance and fixing/separating performance.

Moreover, preferably, the resin (2) is a vinyl modified polyester resin in order to better achieve the effect of being able to suppress filming and being able to maintain fluidity while maintaining low temperature fixing performance.

(Vinyl Type Polymerization Segment and Polyester Type Polymerization Segment)

Preferably, according to the present embodiment, the resin (2) is resin in which the vinyl type polymerization segment composed of styrene-acrylic type polymer, etc. and the polyester type polymerization segment composed of amorphous polyester are bonded through both reactive monomer. The vinyl type polymerization segment is a polymer portion obtained by polymerizing the aromatic vinyl type monomer and the (meth)acrylic acid ester type monomer.

According to the present invention, preferably, the content ratio of the vinyl type polymerization segment in the resin (2) is within the range of 1 to 30% by mass with respect to the entire mass of the vinyl modified polyester resin, and especially preferable within the range of 5 to 10% by mass. Since the compatibility with the resin (1) increases when the content ratio of the vinyl type polymerization segment is 1% by mass or more, it is possible to suppress the convex portion separating from the toner mother particle and to avoid the possibility of filming. Moreover, when the ratio is 30% by mass or less, it is possible to avoid the possibility of the low temperature fixing performance becoming worse. Therefore, when the content ratio of the vinyl type polymerization segment is within the above range, it is possible to achieve the effect of further being able to suppress filming and being able to maintain low temperature fixing performance.

The content ratio of the vinyl type polymerization segment in resin (2) is specifically, the ratio of the weight of the aromatic type vinyl monomer and the meth(acrylic) acid ester type monomer which forms the vinyl type polymerization segment with respect to the entire weight of the resin material used to synthesize the vinyl modified polyester resin, in other words, the entire weight after adding the following, the polmerizable monomer which forms the non-modified polyester resin which is to be the polyester type polymerization segment, the aromtaic type vinyl monomer and the (meth)acrylic acid ester type monomer which are to be the vinyl type polymerization segment and the both reactive monomer to bond the above.

In the toner of the present invention, preferably, unsaturated aliphatic dicarboxylic acid is used as the polycarboxylic acid monomer to form the polyester type polymerization segment of the resin (2) and a structural unit from the unsaturated aliphatic dicarboxylic acid is included in the polyester type polymerization segment. The unsaturated aliphatic dicarboxylic acid is a chain dicarboxylic acid including a vinylene group in the molecule. Here, the structure unit is a unit of a molecular structure from the monomer in the resin.

Preferably, the content ratio of the structural unit from the unsaturated aliphatic dicarboxylic acid in the structural unit from the polycarboxylic acid monomer composing the polyester type polymerization segment of the resin (2) (hereinafter also referred to as "specific unsaturated dicarboxylic acid content ratio") is within the range of 18 to 75 mol %, even more preferably within the range of 25 to 60 mol %, and especially within the range of 30 to 60 mol %.

Preferably, the structural unit from the unsaturated aliphatic dicarboxylic acid is the structural unit from a component which is represented by the following general formula (A).

$$HOOC—(CR_1{=}CR_2)_n—COOH \qquad \text{General formula (A):}$$

(In the formula, $R_1$ and $R_2$ show a hydrogen atom, a methyl group or an ethyl group, and can be the same or different. Here, n is an integer number of 1 or 2.)

Since the structural unit from the unsaturated aliphatic dicarboxylic acid is included, the hydrophilic nature of the polyester resin increases due to the carbon-carbon double bond. Therefore, when the toner particle is formed in the aqueous medium by the emulsion aggregation method, the effect that the polyester resin segment being oriented outside the core particle, in other words, to the aqueous medium side, becomes large, and it becomes more easier for the convex portion to be formed on the surface of the toner mother particle. According to the present invention, when the unsaturated aliphatic dicarboxylic acid represented by the general formula (A) is used in the polymerization reaction, it is possible to use the anhydrous form.

Preferably, from the view point of low temperature fixing performance, the glass transition temperature of the resin (2) of the present invention is within the range of 50 to 70° C., and more preferably within the range of 50 to 65° C. Preferably, the softening temperature of the resin (2) of the present invention is within the range of 80 to 110° C.

(Measuring Method of Glass Transition Temperature (Tg))

The glass transition temperature of the resin (2) is a value measured by the method defined by ASTM (American Society for Testing and Materials) D3418-12el (DSC method), and can be measured by the method similar to the method used for the above described resin (1).

(Measuring Method of Softening Point (Tsp))

The softening point of the resin (2) can be measured by the method similar to the method used for the above described resin (1).

<Manufacturing Method of Vinyl Modified Polyester Resin>

A well-known typical scheme can be used as the method for manufacturing vinyl modified polyester resin which is an example of the above-described resin (2) included in the toner mother particle. The following four methods are representative methods.

(A) A method of forming vinyl type polymerization segment in which polyester type polymerization segment is polymerized in advance, both reactive monomer is reacted in the polyester type polymerization segment and further the aromatic type vinyl monomer and (meth)acrylic acid ester type monomer for forming the vinyl type polymerization segment are reacted. In other words, a method in which the aromatic type vinyl monomer and the (meth)acrylic acid ester type monomer for forming the vinyl type polymerization segment is polymerized with the both reactive monomer including a group which can be reacted with the polycarboxylic acid monomer or polyalcohol monomer for forming the polyester type polymerization segment and a polymerizable unsaturated group and with the non-modified polyester resin.

(B) A method of forming polyester type polymerization segment in which vinyl type polymerization segment is polymerized in advance, both reactive monomer is reacted in the vinyl type polymerization segment, and polycarboxylic acid monomer and polyalcohol monomer for forming the polyester type polymerization segment are reacted.

(C) A method of bonding the polyester type polymerization segment and the vinyl type polymerization segment where the polyester type polymerization segment and the vinyl type polymerization segment are each polymerized in advance and the both reactive monomer is reacted in the above.

(D) A method of bonding the polyester type polymerization segment and the vinyl type polymerization segment where the polyester type polymerization segment is polymerized in advance, and the vinyl type polymerizable monomer is added for polymerization in the polymerizable unsaturated group of the polyester type polymerization segment or the vinyl group in the vinyl type polymerization segment is reacted with the polymerizable unsaturated group of the polyester type polymerization segment.

Here, the both reactive monomer is monomer including a group which can be reacted with the polycarboxylic acid monomer or polyalcohol monomer for forming the polyester type polymerization segment of the resin (2) and the polymerizable unsaturated group.

Specifically, the method of (A) includes the following steps.

(1) Mixing step in which the following are mixed, (i) non-modified polyester resin for forming the polyester type polymerization segment, (ii) aromatic type vinyl monomer and (meth)acrylic acid ester type monomer, and (iii) both reactive monomer.

(2) By going through a polymerizing step in which aromatic type vinyl monomer and the (meth)acrylic acid ester type monomer are polymerized in the presence of both reactive monomer and non-modified polyester resin, vinyl type polymerization segment can be formed in an end of the polyester type polymerization segment. In this case, the hydroxyl group of the end of the polyester type polymerization segment and the carboxy group of the both reactive monomer form an ester bonding. The vinyl group of the both reactive monomer and the vinyl group of the aromatic type vinyl monomer or the (meth)acrylic acid type monomer bond, and the vinyl type polymerization segment is bonded. Among the methods of synthesizing, the method (A) is most preferable.

Preferably, heating is performed in the mixing step described in the above noted (1). The heating temperature is to be a range where the non-modified polyester resin, the aromatic type vinyl monomer, the (meth)acrylic acid ester type monomer, and the both reactive monomer can be mixed. Since good mixing can be obtained and control of polymerization becomes easier, for example, the temperature can be within the range of 80 to 120° C., more preferably within the range of 85 to 115° C., and even more preferably within the range of 90 to 110° C.

Preferably, the relative percentage of the aromatic type vinyl monomer and the (meth)acrylic acid ester type monomer is a percentage so that the glass transition temperature (Tg) calculated by the FOX formula represented by the formula (i) below is within the range of 35 to 80° C., and preferably within the range of 40 to 60° C. Formula (i): $1/Tg=\Sigma(Wx/Tgx)$ (In formula (i), Wx is mass fraction of monomer x, Tgx is the glass transition temperature of the homopolymer of the monomer x.)

According to the present specification, the both reactive monomer is not used in the calculation of the glass transition temperature.

(Added Amount of Both Reactive Monomer)

Among the non-modified polyester resin, the aromatic type vinyl monomer, the (meth)acrylic acid ester type monomer, and the both reactive monomer, regarding the percentage of the both reactive monomer to be used, when the total mass of the resin material to be used, in other words, the total mass of the above four is 100% by mass, preferably, the ratio of the both reactive monomer is 0.1 to 5.0% by mass or less, and more preferably, 0.5 to 3.0% by mass or less.

(Both Reactive Monomer)

The both reactive monomer for forming the vinyl type polymerization segment is to be a monomer including a group which is able to react with the polycarboxylic acid monomer or polyalcohol monomer for forming the polyester type polymerization segment and the polymerizable unsaturated group, and specifically, the following can be used, for example, acrylic acid, methacrylic acid, fumaric acid, maleic acid, and maleic acid anhydride. It is preferable to use the acrylic acid or the methacrylic acid as the both reactive monomer in the present invention.

<Vinyl Type Polymerization Segment>

The aromatic type vinyl monomer and the (meth)acrylic acid ester type monomer for forming the vinyl type polymerization segment includes ethylene unsaturated bond which can perform radical polymerization.

(Aromatic Type Vinyl Monomer and the (Meth)Acrylic Acid Ester Type Monomer)

Examples of aromatic type vinyl monomer include the following, styrene, o-methylstryrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene, 3,4-dichlorostyrene, etc., and derivatives thereof.

The above aromatic type vinyl monomer can be used alone or by combining two or more types.

Examples of a (meth)acrylic acid ester type monomer include the following, methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, β-hydroxyethyl acrylate, γ-amino propyl acrylate, stearyl methacrylate, dimethylaminoethyl methacrylate, and diethylaminoethyl methacrylate. The above (meth)acrylic acid ester type monomer can be used alone or by combining two or more types.

From the view point of obtaining excellent charging and image quality attribute, it is preferable to mainly use styrene or its derivatives as the aromatic type vinyl monomer and the (meth)acrylic acid ester type monomer for forming the vinyl type polymerization segment. Specifically, preferably, the amount of styrene or its derivatives used in the entire amount of monomer used for forming the styrene-acrylic type polymerization segment (aromatic type vinyl monomer and (meth)acrylic acid ester type monomer) is 50% by mass or more.

(Polymerization Initiator)

Preferably, in the above described polymerization step where the aromatic type vinyl monomer and the (meth) acrylic acid ester type monomer are polymerized, the polymerization is performed in the presence of a radical polymerization initiator. The timing that the radical polymerization initiator is added is not limited. Preferably, the radical polymerization initiator is added after the mixing step to enable easier control of the radical polymerization.

Various well-known polymerization initiators are suitably used as the polymerization initiator. Specifically, examples of polymerization initiators include, peroxides such as, hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, ammonium persulfate, sodium persulfate, potassium persulfate, peroxy diisopropyl carbonate, tetraphosphor hydroperoxide, 1-phenyl-2-methylpropyl-1-hydroperoxide, pertriphenyl tert-hydroperoxide acetate, tert-butyl performate, tert-butyl peracetate, tert-butyl perbenzoate, tert-butyl perphenyl acetate, tert-butyl permethoxy acetate, and per N-(3-tolyl)tert-butyl palmitate; and azo compounds such as 2,2'-azobis(2-amidinopropane) hydrochloride, 2,2'-azobis(2-amidinopropane) nitrate, 1,1'-azobis(1-methylbutylonitrile-3-sodium sulfonate), 4,4'-azobis-4-cyanovalerate, and poly(tetraethyleneglycol-2,2'-azobis isobutyrate). The added amount of the polymerization initiator is different depending on the desired molecular weight and the molecular weight distribution. Specifically, it is preferable to add the polymerization initiator within the range of 0.1 to 5.0% by mass with respect to the polymerizable monomer.

(Chain Transfer Agent)

Typically used chain transfer agents can be used for the purpose of adjusting the molecular weight of the styrene-acrylic type polymerization segment in the above described polymerizing step to polymerize the aromatic type vinyl monomer and the (meth)acrylic acid ester type monomer. The chain transfer agent is not limited, and examples include alkyl mercaptan, mercapto fatty acid ester, and the like.

Preferably, the chain transfer agent is mixed with resin forming material in the above described mixing step.

The added amount of the chain transfer agent is different depending on the desired molecular weight and the molecular weight distribution of the styrene-acrylic type polymerization segment. Specifically, it is preferable that the chain transfer agent is added within the range of 0.1 to 5.0% by mass with respect to the total mass of the aromatic type vinyl monomer, the (meth)acrylic acid ester type monomer, and the both reactive monomer.

The polymerization temperature of the above described polymerization step where the aromatic type vinyl monomer and the (meth)acrylic acid ester type monomer are polymerized is not limited. The temperature can be suitably selected within the range that the polymerization of the aromatic type vinyl monomer and the (meth)acrylic acid ester type monomer progresses and the bonding to the polyester resin progresses. For example, as the polymerization temperature, the range within 85 to 125° C. is preferable, the range within 90 to 120° C. is more preferable, and the range within 95 to 115° C. is further preferable.

<Polyester Type Polymerization Segment>

Preferably, the resin used for making the polyester type polymerization segment composing the resin (2) of the present invention is resin manufactured from raw material including polycarboxylic acid monomer (derivative) and polyalcohol monomer (derivative) by polycondensation reaction in the presence of a suitable catalyst.

The following can be used as the polycarboxylic acid monomer, alkyl ester, acid anhydride, and acid chloride of the polycarboxylic acid monomer. The following can be used as the polyalcohol monomer, ester compound, and hydroxycarboxylic acid of the polyalcohol monomer.

The polycarboxylic acid monomer includes the following, for example, divalent carboxylic acid such as, oxalic acid, succinic acid, maleic acid, adipic acid, β-methyl adipic acid, azelaic acid, sebacic acid, nonane dicarboxylic acid, decane dicarboxylic acid, undecane dicarboxylic acid, dodecane dicarboxylic acid, fumaric acid, citraconic acid, diglycol acid, cyclohexane-3,5-diene-1,2-dicarboxylic acid, malic acid, citric acid, hexahydro terephtalic acid, malonic acid, pimelic acid, tartaric acid, mucic acid, phthalic acid, isophthalic acid, terephthalic acid, tetrachlorophthalic acid, chlorophthalic acid, nitrophthalic acid, p-caboxyphenylacetic acid, p-phenylene diacetate, m-phenylene diglycol acid, p-phenylene diglycol acid, o-phenylene diglycol acid, diphenylacetic acid, diphenyl-p,p'-dicarboxylic acid, naphthalane-1,4-dicarboxylic acid, naphthalane-1,5-dicarboxylic acid, naphthalane-2,6-dicarboxylic acid, anthracene dicarboxylic acid, dodecenyl succinic acid, etc.; and trivalent or more carboxylic acid such as trimellitic acid, pyromellitic acid, naphthalene tricarboxylic acid, naphthalene tetracarboxylic acid, pyrene tricarboxylic acid, pyrene tetracarboxylic acid, etc., and the like.

The polycarboxylic acid monomer used is preferably unsaturated aliphatic dicarboxylic acid such as fumaric acid, maleic acid, and mesaconic acid. Especially, the unsaturated aliphatic dicarboxylic acid represented by the above general formula (A) is preferably used. According to the present invention, anhydride of dicarboxylic acid such as maleic acid anhydride can be used.

The polyalcohol monomer includes the following, for example, divalent alcohol such as ethylene glycol, propylene glycol, butane diol, diethylene glycol, hexane diol, cyclohexane diol, octane diol, decane diol, dodecane diol, ethylene oxide adduct of bisphenol A, propylene oxide adduct of bisphenol A, etc.; polyol of trivalent or more such as glycerin, pentaerythritol, hexamethylol melamine, hexaethylol melamine, tetramethylol benzoguanamine, tetraethylol benzoguanamine, etc. and the like.

When the resin (2) of the present invention includes the polyester type polymerization segment, preferably, the polyester type polymerization segment is amorphous polyester. In order to form amorphous polyester, preferably, a monomer which does not include a straight alkyl group is used as the polycarboxylic acid and polyalcohol. Preferably, the following is used as the polyalcohol monomer, for example, a divalent alcohol including an aromatic ring such as ethylene oxide adduct of bisphenol A, propylene oxide adduct of bisphenol A, etc.

The ratio between the above polycarboxylic acid monomer and the polyalcohol monomer is an equivalent ratio [OH]/[COOH] between the hydroxyl group [OH] of the polyalcohol monomer and the carboxy group [COOH] of the polycarboxylic acid being preferably 1.5/1 to 1/1.5 and more preferably 1.2/1 to 1/1.2.

Various conventionally well-known catalysts can be used as the catalyst for synthesizing the polyester resin.

The amorphous polyester resin for obtaining the resin (2) has a glass transition temperature preferably within the range of 40 to 70° C., and more preferably within the range of 50 to 65° C. When the glass transition temperature of the amorphous polyester resin is 40° C. or more, the aggregation force of the polyester resin in the high temperature region becomes suitable and it is possible to suppress hot offset in fixing. When the glass transition temperature of the amorphous polyester resin is 70° C. or less, sufficient melting can be achieved in fixing so that a suitable minimum fixing temperature can be secured.

The weight average molecular weight (Mw) of the amorphous polyester resin is preferably within the range of 1500 to 60000, and more preferably within the range of 3000 to 40000.

When the weight average molecular weight is 1500 or more, suitable aggregation force can be obtained in the entire resin (1), and high temperature offset in fixing is suppressed. When the weight average molecular weight is 60000 or less, sufficient melt viscosity can be obtained, and sufficient minimum fixing temperature can be secured. Therefore, the low temperature offset is suppressed in fixing.

A branching structure or a bridged structure can be partially formed in the amorphous polyester resin by selecting the valence of carboxylic acid or the valence of alcohol in the polycarboxylic acid monomer or the polyalcohol monomer used.

When making the resin (2), the volatile organic matter from emulsion such as residual monomer after the polymerization step is suppressed to 1000 ppm or less to be preferable in use, more preferably 500 ppm or less, and even more preferably 200 ppm or less.

A colorant, a mold release agent, a charge control agent or the like can be added to the toner mother particle of the present invention as necessary.

<Colorant>

When the toner mother particle includes the colorant, carbon black, a magnetic material, a dye, a pigment or the like can be arbitrarily used as the colorant.

As carbon black, channel black, furnace black, acetylene black, thermal black, and lamp black can be used.

Examples of magnetic material that can be used include the following, ferromagnetic metal such as iron, nickel, cobalt, etc., alloy including the above metal, and compound of the ferromagnetic metal such as ferrite, magnetite, etc.

As pigment, the following can be used, C.I. pigment red 2, C.I. pigment red 3, C.I. pigment red 5, C.I. pigment red 7, C.I. pigment red 15, C.I. pigment red 16, C.I. pigment red 48:1, C.I. pigment red 48:3, C.I. pigment red 53:1, C.I. pigment red 57:1, C.I. pigment red 81:4, C.I. pigment red 122, C.I. pigment red 123, C.I. pigment red 139, C.I. pigment red 144, C.I. pigment red 149, C.I. pigment red 166, C.I. pigment red 177, C.I. pigment red 178, C.I. pigment red 208, C.I. pigment red 209, C.I. pigment red 222, C.I. pigment orange 31, C.I. pigment orange 43, C.I. pigment yellow 3, C.I. pigment yellow 9, C.I. pigment yellow 14, C.I. pigment yellow 17, C.I. pigment yellow 35, C.I. pigment yellow 36, C.I. pigment yellow 65, C.I. pigment yellow 74, C.I. pigment yellow 83, C.I. pigment yellow 93, C.I. pigment yellow 94, C.I. pigment yellow 98, C.I. pigment yellow 110, C.I. pigment yellow 111, C.I. pigment yellow 138, C.I. pigment yellow 139, C.I. pigment yellow 153, C.I. pigment yellow 155, C.I. pigment yellow 180, C.I. pigment yellow 181, C.I. pigment yellow 185, C.I. pigment green 7, C.I. pigment blue 15:3, C.I. pigment blue 15:4, C.I. pigment blue 60, phthalocyanine pigment in which the main metal is zinc, titanium, magnesium, etc., and mixtures of the above. As dye, the following can be used, C.I. solvent red 1, C.I. solvent red 3, C.I. solvent red 14, C.I. solvent red 17, C.I. solvent red 18, C.I. solvent red 22, C.I. solvent red 23, C.I. solvent red 49, C.I. solvent red 51, C.I. solvent red 52, C.I. solvent red 58, C.I. solvent red 63, C.I. solvent red 87, C.I. solvent red 111, C.I. solvent red 122, C.I. solvent red 127, C.I. solvent red 128, C.I. solvent red 131, C.I. solvent red 145, C.I. solvent red 146, C.I. solvent red 149, C.I. solvent red 150, C.I. solvent red 151, C.I. solvent red 152, C.I. solvent red 153, C.I. solvent red 154, C.I. solvent red 155, C.I. solvent red 156, C.I. solvent red 157, C.I. solvent red 158, C.I. solvent red 176, C.I. solvent red 179, pyrazolotriazole azo dye, pyrazolotriazole azomethine dye, pyrazolone azo dye, pyrazolone azomethine dye, C.I. solvent yellow 19, C.I. solvent yellow 44, C.I. solvent yellow 77, C.I. solvent yellow 79, C.I. solvent yellow 81, C.I. solvent yellow 82, C.I. solvent yellow 93, C.I. solvent yellow 98, C.I. solvent yellow 103, C.I. solvent yellow 104, C.I. solvent yellow 112, C.I. solvent yellow 162, C.I. solvent blue 25, C.I. solvent blue 36, C.I. solvent blue 60, C.I. solvent blue 70, C.I. solvent blue 93, C.I. solvent blue 95, etc. and mixtures of the above.

The number average primary particle diameter of the colorant is different depending on the type, and preferably, the diameter is about 10 to 200 nm.

The content ratio of the colorant in the toner with respect to the total mass of the resin (1) when the toner mother particle includes the colorant is preferably within the range of 1 to 30% by mass, and more preferably within the range of 2 to 20% by mass.

<Mold Release Agent>

A mold release agent can be used in the toner mother particle of the present invention, and wax can be added as the mold release agent. For example, the following wax can be used, hydrocarbon type wax group such as low molecular mass polyethylene wax, low molecular mass polypropylene wax, Fischer Tropsch wax, microcrystalline wax, paraffin wax, ester wax group such as carnauba wax, pentaerythritol ester behenate, behenyl behenate, behenyl citrate, and the like. The above can be used alone or in combination of two or more types.

From the viewpoint of reliably obtaining low temperature fixing performance and mold separating performance of the toner, the melting temperature of the wax which is used is preferably within the range of 50 to 95° C. The content ratio of the wax with respect to the entire mass of the resin (1) is preferably within the range of 2 to 20% by mass, more preferably within the range of 3 to 18% by mass, and even more preferably within the range of 4 to 15% by mass.

<Charge Control Agent>

Various well-known charge control agents can be used in the toner mother particle of the present invention.

Various well-known compounds which can be dispersed in an aqueous medium can be used as the charge control agent. Specific examples include, nigrosine type dye, metallic salt of naphthenic acid or higher fatty acid, amine alkoxylate, quarternary ammonium salt compound, azo type metal complex, salicylic acid metallic salt or its metal complex, etc.

The content ratio of the charge control agent with respect to the total mass of the resin (1) is preferably within the range of 0.1 to 10.0% by mass, and more preferably within the range of 0.5 to 5.0% by mass.

<<Description of Toner Particle>>

Next, the toner mother particle of the present invention can be used as the toner particle as is, however, normally it is preferable to use the toner mother particle by adding an additive. According to the present invention, the "toner mother particle" added with the additive is to be the "toner particle". Here, the "toner" is to be an aggregate of the "toner particle".

(Average Degree of Circularity of Toner Particle)

The average degree of circularity of the toner particle used in the present invention is described. Preferably, the average degree of circularity of the toner particle used in the present invention is within the range of 0.850 to 0.990.

Here, the average degree of circularity of the toner particle is a value measured using the flow type particle image analysis apparatus "FPIA-2100" (manufactured by Sysmex Corporation).

Specifically, the toner particle is moistened in an aqueous surfactant solution, and ultrasonic dispersion is performed for 1 minute. After dispersion, measurement is performed in a suitable concentration within the range of HPF (high power field imaging) detected number 3000 to 10000 under a measurement condition in a HPF mode using the "FPIA-2100". A reproducible measurement value can be obtained within the above range. The degree of circularity is calculated by the formula below.

degree of circularity=(circumference of circle with same projected area as particle image)/(circumference of particle projected image)

The average degree of circularity is the average value calculated by adding the degree of circularity of each particle and dividing the above with the total number of measured particles.

(Particle Diameter of Toner Particle)

Next, the particle diameter of the toner particle used in the present invention is described. Preferably, the particle diameter of the toner particle used in the present invention is within the range of 3 to 10 μm in a volumetric basis median diameter ($D_{50}$% diameter).

Since the volumetric basis median diameter ($D_{50}$% diameter) is within the above range, it is possible to accurately reproduce the extremely fine dot image at a level of, for example, 1200 dpi (dpi; number of dots per inch (2.54 cm)).

The volumetric basis median diameter ($D_{50}$% diameter) of the toner particle can be measured and calculated by connecting an apparatus such as "Multisizer 3 (manufactured by Beckman Coulter, Inc.)" to a computer system for data processing.

In the measuring process, 0.02 g of the toner particle is blended in 20 ml of the surfactant solution (for the purpose of dispersing toner particles, for example, a surfactant solution in which a neutral detergent including a surfactant component is diluted by 10 times with pure water), ultrasonic dispersion is performed for 1 minute and a toner particle dispersion liquid is made. This toner particle dispersion liquid is poured into a beaker including ISOTON II (manufactured by Beckman Coulter, Inc.) in the sample stand with a pipette until the measurement concentration is within the range of 5 to 10% by mass, and the liquid is measured setting the measurement counter to 25000. The aperture diameter of the Multisizer 3 used is 100 μm. The frequency count is calculated by dividing the range of the measurement range 1 to 30 μm by 256 and the particle diameter at 50% from the volumetric integrated fraction with a large value is to be the volumetric basis median diameter ($D_{50}$% diameter).

(Softening Point of Toner)

Preferably, the softening point of the toner of the present invention is 90 to 115° C. When the softening point of the toner is within this range, preferable low temperature fixing performance can be achieved.

The softening point can be measured by the above described method, in other words, the flow tester "CFT-500D" (manufactured by Shimadzu Corporation).

<<Manufacturing Method of Toner>>

<Manufacturing Method of Toner Mother Particle>

The method for manufacturing the toner mother particle of the present invention includes, suspension polymerization method, emulsion aggregation method, and other well-known methods. Preferably, the emulsion aggregation method is employed. From the view point of manufacturing cost and manufacturing stability, according to the emulsion aggregation method, it is possible to easily achieve smaller particle diameter of toner particles.

Here, the emulsion aggregation method is a method of manufacturing toner particle by the following. The dispersion liquid of the particle of the resin (1) manufactured by emulsifying (hereinafter also referred to as "resin (1) particle" is mixed with the dispersion liquid of the particle of the colorant (hereinafter also referred to as "colorant particle") as necessary to aggregate until the desired toner particle diameter is obtained, and further, the shape is controlled by fusing among resin (1) particles. Here, the particle of the resin (1) can arbitrarily include the mold release agent, the charge control agent, and the like.

Preferably, the toner mother particle of the present invention is manufactured by the emulsion aggregation method.

An example of the process of manufacturing the toner mother particle when the toner mother particle of the present invention is manufactured by the emulsion aggregation method is specifically described as follows.

Step (1): Prepare dispersion liquid of resin (1) particle from resin (1)

Step (2): Prepare dispersion liquid of resin (2) particle from resin (2)

Step (3): Aggregate resin (1) particle included in dispersion liquid of resin (1) particle and form toner mother particle precursor Step (4): Fuse the resin (2) particle to the toner mother particle precursor in the aqueous medium and form toner mother particle With this, the toner mother particle is formed.

The resin (1) particle in the above step (1) can include a multilayer structure of 2 or more layers from resin with different composition. The resin (1) particle with such structure can be obtained by the following. For example, in a 2 layer structure, first the dispersion liquid with the resin particle is prepared by the emulsion polymerization process (first polymerization) according to the usual method, the polymerization initiator and the polymerizable monomer are added to this dispersion liquid, and the polymerization process (second polymerization) is performed on the above. Moreover, the polymerizable monomer can be further added as necessary and third polymerization can be performed to achieve a 3 layer structure.

After the above step (4), the toner mother particle is filtered from the aqueous medium. Then, a cleaning step to remove the surfactant from the toner mother particle, and a drying step to dry the cleaned toner mother particle is performed. Further, the additive adding step to add the additive to the dried toner mother particle is performed as necessary. With this, the toner particle can be manufactured.

According to the present invention, the "aqueous medium" is a medium including 50 to 100% by mass of water and 0 to 50% by mass of water soluble organic solvent. Examples of water soluble organic solvent include, methanol, ethanol, isopropanol, butanol, acetone, methyl ethyl ketone, and tetrahydrofuran. An alcohol type organic solvent which does not dissolve the obtained resin is preferable.

(Step (1): Preparing Dispersion Liquid of Resin (1) Particle from Resin (1))

In step (1), the dispersion liquid of the resin (1) particle from the resin (1) is prepared.

The dispersion liquid of the resin (1) particle from the resin (1) can be prepared by emulsion polymerization in the aqueous medium.

When the surfactant is used in the polymerization step of the resin (1), for example, the following surfactants can be used as the surfactant.

[Surfactant]

Preferably, the surfactant is added in the aqueous medium as the dispersion stabilizer to prevent aggregation of the dispersed particle.

Various well-known cationic surfactant, anionic surfactant, and non-ionic surfactant can be used as the surfactant.

Specific examples of the cationic surfactant include the following, dodecyl ammonium bromide, dodecyl trimethyl ammonium bromide, dodecyl pyridinium chloride, dodecyl pyridinium bromide, hexadecyl trimethyl ammonium bromide, and the like.

Specific examples of the non-ionic surfactant include the following, dodecyl polyoxyethylene ether, hexadecyl polyoxyethylene ether, nolylphenyl polyoxyethylene ether, lauryl polyoxyethylene ether, sorbitan monooleate polyoxyethylene ether, styryl phenyl polyoxyethylene ether, monodecanoyl sucrose, and the like.

Specific examples of the anionic surfactant include the following, fatty type soap such as sodium stearate, sodium laurate, etc., sodium lauryl sulfate, sodium dodecylbenzenesulfonate, sodium polyoxyethylene (2) laurylether sulfate, and the like.

The above surfactants can be used alone or in combination of two or more types depending on the needs of the user.

The toner mother particle of the present invention includes at least the resin (1), and other than the above, internal additives such as colorant, wax, charge control agent or magnetic powder can be included as necessary. Such internal additive can be introduced in the toner particle by, for example, in the polymerization step of resin (1), dissolving or dispersing in advance in the monomer solution for forming the resin (1).

Alternatively, the above internal additive can be introduced in the toner particle by separately preparing a dispersion liquid of the internal additive particle formed from only the internal additive and aggregating the internal additive particle together with the resin (1) particle and the colorant particle in step (3). However, it is preferable to employ the method in which the internal additive is introduced in advance in the polymerization step of resin (1).

The average particle diameter of the resin (1) particle obtained in the polymerization step of the resin (1) is preferably within the range of, for example, 50 to 500 nm in the volumetric basis median diameter ($D_{50}$% diameter).

The volumetric basis median diameter ($D_{50}$% diameter) is measured using the micro track particle size distribution measurement apparatus "UPA-150" (manufactured by Nikkiso Co., Ltd.).

(Step (2): Preparing Dispersion Liquid of Resin (2) Particle from Resin (2))

In step (2), the dispersion liquid of the resin particle (resin (2) particle) from the resin (2) is prepared.

The following methods can be used to prepare the dispersion liquid of the resin (2) particle from the resin (2). Specifically, for example, a method of grinding the resin by a mechanical method and dispersing in the aqueous medium using the surfactant, a method of pouring and dispersing in the aqueous medium a resin (2) solvent in which the resin (2) is dissolved in the organic solvent to make the aqueous medium dispersion liquid, a method of mixing the resin (2) in a melted state in the aqueous medium and making the aqueous medium dispersion liquid by a mechanical dispersion method, a phase transfer emulsion method and the like. According to the present invention, any method can be employed.

The average particle diameter of the resin (2) particle (resin particle including at least the resin (2) in the present invention) obtained in step (2) is preferably within the range of, for example, 50 to 500 nm in the volumetric basis median diameter ($D_{50}$% diameter).

When the surfactant is used in step (2), the surfactants that can be used are the same as those described as the surfactants which can be used in the above described resin (1) particle dispersion liquid preparing step.

(Colorant Particle Dispersion Liquid Preparing Step)

When the colorant is included in the toner mother particle, preferably, the step to prepare the colorant particle dispersion liquid is performed.

Specifically, the colorant particle dispersion liquid can be prepared by dispersing colorant in the aqueous medium. Preferably, the dispersion processing of the colorant is performed in a state where surfactant concentration in the aqueous medium is critical micelle concentration (CMC) or more so that the colorant is dispersed evenly. Various well-known dispersers can be used as the disperser used in the dispersion processing of the colorant.

The surfactants that can be used are the same as those described as the surfactants which can be used in the above described resin (1) particle dispersion liquid preparing step.

The dispersion diameter of the colorant particle in the colorant particle dispersion liquid prepared in the colorant particle dispersion liquid preparing step is preferably within the range of, for example, 10 to 300 nm in the volumetric basis median diameter ($D_{50}$% diameter).

The volumetric basis median diameter ($D_{50}$% diameter) of the colorant particle in the colorant particle dispersion liquid is measured using the electrophoretic light scattering photometer "ELS-800" (manufactured by Otsuka Electronics Co., Ltd.).

(Step (3): Aggregating the Resin (1) Particle Included in the Dispersion Liquid of Resin (1) Particle and Forming the Toner Mother Particle Precursor)

In step (3), the resin (1) particle included in the dispersion liquid of the resin (1) particle is aggregated to form the toner mother particle precursor.

In step (3), other particles of the toner component such as offset preventing agent such as wax, charge control agent and colorant particle can be aggregated to the resin (1) particle according to necessity.

The specific method of aggregating the resin (1) particle included in the dispersion liquid of the resin (1) particle to form the toner mother particle precursor is not limited. An example of such method is adding the aggregation agent in the aqueous medium so that the concentration becomes the critical aggregation concentration or more, and then heating to a temperature equal to or more than the glass transition temperature of the resin (1) particle and equal to or less than the melting peak temperature of the above mixture to progress the salting out of the particle such as the resin (1) particle and the colorant particle simultaneously with the fusing.

Preferably, heating is done promptly after adding the aggregation agent making the time left as is as short as possible at a temperature equal to or more than the glass transition temperature of the resin (1) particle and equal to or less than the melting peak temperature of the above mixture. Although the reason is not clear, there is a possibility that problems may occur such as, the aggregation state of the particle may change depending on the time of being left as is after salting out and the particle diameter distribution may become unstable, or the surface nature of the fused particle may change. Preferably, the time until the heating starts is usually within 30 minutes or less, and more preferably within 10 minutes or less. Preferably, the heating speed is 1° C. per minute or more. The upper limit of the heating speed is not specifically defined. Preferably, from the viewpoint of suppressing coarse particles due to progress of rapid fusing, the upper limit is 15° C. per minute or less. Further, after the reacted result reaches the temperature equal to or more than the glass transition temperature, it is important to maintain the temperature of the reacted result for a certain period of time to continue fusing. With this, the growth of the toner mother particle precursor and the fusing can effectively progress, and with this, the durability of the finally obtained toner particle can be enhanced.

(Aggregation Agent)

The aggregation agent used in step (3) is not limited, and the aggregation agent selected from metallic salt is suitably used. Examples of metallic salt include, for example, univalent metallic salt such as salt of alkali metal such as sodium, potassium, and lithium; divalent metallic salt such as calcium, magnesium, manganese, and copper; and trivalent metallic salt such as iron and aluminum. Examples of specific metallic salt include, sodium chloride, potassium chloride, lithium chloride, calcium chloride, magnesium chloride, zinc chloride, copper sulfate, magnesium sulfate, and manganese sulfate. Among the above, it is especially preferable to use divalent metallic salt because it is possible to progress aggregation with a smaller amount. The above can be used alone or in combination of two or more types.

The particle diameter of the toner mother particle precursor obtained in step (3) is preferably within the range of, for example, 3 to 10 μm in the volumetric basis median diameter ($D_{50}$% diameter), and more preferably within the range of 4 to 7 μm.

The volumetric basis median diameter ($D_{50}$% diameter) of the toner mother particle precursor is measured by the "Coulter Multisizer 3" (manufactured by Beckman Coulter, Inc.).

(Step (4): Forming Toner Mother Particle)

In step (4), the resin (2) particle is fused to the toner mother particle precursor in the aqueous medium to form the toner mother particle. Specifically, in step (3), when the toner mother particle grows to a desired particle diameter, the dispersion liquid of the resin (2) particle is poured in the aqueous medium (reacting liquid) of step (3), and the resin (2) particle is attached to the toner mother particle precursor. Then, the pH of the aqueous medium (reacting liquid) is adjusted by the pH adjuster and the particle is fused.

A specific method is as follows, first, the aggregation agent is added to the reacting liquid to be the critical aggregation concentration or more, and then the result is heated to a temperature equal to or more than the glass transition temperature of the resin (2) particle and equal to or less than the melting peak temperature of the mixture of the above.

Next, when the supernatant of the reacting liquid (aqueous medium) becomes transparent, the aggregation terminator is added and the growth of the particle is terminated. Then, the temperature is raised, and the pH adjuster is added to adjust the pH of the aqueous medium in fusing. The above is heated and mixed in a state within the range of 80 to 90° C.

With this, the convex portion can be formed on the surface of the toner mother particle precursor and the toner mother particle can be formed. When the average degree of circularity measured using the apparatus for measuring the average degree of circularity of the toner "FPIA-2100" (manufactured by Sysmex Corporation) is within the range of 0.930 to 0.950 (HPF detecting number 4000), the above is cooled within the range of 20 to 30° C. to obtain the dispersion liquid of the toner mother particle including the convex portion on the surface.

The pH of the aqueous medium in the step for forming the toner mother particle is preferably within the range of 4 to 7 when measured at a liquid temperature of 80° C. With this, it is possible to achieve the effect of making the length of the long side of the convex portion and the covering percentage to a suitable value. There is a suitable range of pH depending on the carboxy group amount of the resin. For example, since there are many carboxy groups in the molecular end of the polyester resin, the carboxy group amount becomes larger as the styrene-acrylic content ratio of the resin (2) becomes lower. Therefore, it is assumed that when the styrene-acrylic content ratio is low, the dissociated carboxy group amount becomes large compared to when the ratio is high, and in order to form the convex portion with the same size and covering percentage, it is necessary to lower the pH and suppress the dissociation of the carboxy group.

(pH Adjuster)

The pH adjuster used in step (4) is not limited as long as the pH of the aqueous medium can be adjusted, and can be acidic or alkaline. Specific examples include, hydrochloric acid, aqueous sodium hydroxide, and the like.

(Cleaning Step, Drying Step)

Various well-known methods can be employed and performed in the cleaning step and the drying step. In other words, after forming to a predetermined average degree of circularity in the forming step, for example, by using a well-known method such as a centrifuge, solid-liquid separation and cleaning is performed, organic solvent is removed by drying under reduced pressure, and further, the moisture and the fine amount of organic solvent are removed with a well-known drying apparatus such as a flash jet dryer, fluid bed dryer and the like. The drying temperature is not limited as long as the toner is not fused.

(Additive Adding Step)

The additive adding step adds and mixes the additive to the dried toner mother particle as necessary to prepare the toner particle.

The toner mother particle made up to the drying process can be used as the toner particle as is. However, from the view point of enhancing charge performance, fluidity as toner and cleaning performance, preferably, particles such as well-known inorganic and organic particles, and unguent are added as additive on the surface.

Various types can be used in combination as additives.

Examples of inorganic particles include, for example, inorganic oxide particles such as silica particle, alumina particle, and titanic oxide particle, inorganic stearin acid compound particles such as aluminum stearate particle and zinc stearate particle, inorganic titanic acid compound particles such as strontium titanate and zinc titanate, and the like.

Preferably, the surface of such inorganic particles are processed by silane coupling agent, titanium coupling agent, higher fatty acid or silicone oil from the viewpoint of heat resistance storage performance and environment stability.

The added amount of such additive is within the range of 0.05 to 5 parts by mass with respect to 100 parts by mass of toner mother particles, and preferably within the range of 0.1 to 3 parts by mass.

Examples of the method of adding the additive include a dry type method in which additive is added in a powder state to the dried toner mother particle. Examples of mixing apparatuses include, a mechanical mixing apparatus such as Henschel mixer or coffee mill.

[Developer]

The toner of the present invention can be used as the magnetic or non-magnetic one component developer, or mixed with a carrier and used as the two component developer.

Examples of the carrier that can be used include magnetic particles from conventionally well-known material such as metal such as iron, ferrite, and magnetite, and alloys of the above metal with metal such as aluminum or lead. Preferably, among the above, ferrite particle is used. Other examples of the carrier that can be used include coated carrier in which the surface of the magnetic particle is covered with a covering agent such as resin or resin dispersed type carrier in which magnetic fine powder is dispersed in the binder resin.

The carrier has a volumetric average particle diameter preferably within the range of 15 to 100 μm and more preferably within the range of 25 to 80 μm.

EXAMPLES

Below, the present invention is specifically described with reference to the examples below, however, the present invention is not limited to the illustrated examples. In the examples described below, "parts" or "%" are used in the description, and the above represent "parts by mass" or "% by mass" respectively unless otherwise noted.

<Preparation of Resin Particle Dispersion Liquid (A)>

In the present example, the following dispersion liquid is prepared in order to prepare the dispersion liquid of resin particle (A) used as the resin (1) particle formed from resin (1) which mainly constitute the basic portion of the toner mother particle First Polymerization (Preparation of "Resin Particle (a1)" Dispersion Liquid)

An anionic surfactant in which 2.0 parts by mass of the anionic surfactant "sodium lauryl sulfate" is dissolved in 2900 parts by mass of ion exchange water is prepared in advance in a reaction container attached with a stirring apparatus, a temperature sensor, a temperature control apparatus, a cooling pipe, a nitrogen introducing apparatus, and the internal temperature is raised to 80° C. while stirring at a stirring speed of nitrogen current 230 rpm.

After adding 9.0 parts by mass of polymerization initiator "potassium persulfate (KPS)" in the surfactant solution, and raising the internal temperature to 78° C., the following monomer solution (1) is dropped over 3 hours.

Monomer Solution (1)

styrene 540 parts by mass n-butyl acrylate 270 parts by mass methacrylic acid 65 parts by mass n-octylmercaptan 17 parts by mass After finishing dropping, polymerization (first polymerization) is performed by heating and stirring over 1 hour at 78° C. and the dispersion liquid of "resin particle (a1)" is prepared.

Second Polymerization: Forming Intermediate Layer (Preparing "Resin Particle (all)" Dispersion Liquid)

The following monomer solution (2) is in a flask attached with the stirring apparatus.

Monomer Solution (2)

styrene 94 parts by mass n-butyl acrylate 60 parts by mass methacrylic acid 11 parts by mass n-octylmercaptan 5 parts by mass 51 parts by mass of paraffin wax (melting temperature: 73° C.) as the mold release agent is added in the monomer solution. The temperature is raised to 85° C. and the above is dissolved to prepare the monomer solution (2).

The surfactant solution in which 2 parts by mass of the anionic surfactant "sodium lauryl sulfate" is dissolved in 1100 parts by mass of ion exchange water is heated to 90° C. After the dispersion liquid of the "resin particle (a1)" is added in the surfactant solution in the amount of 28 parts by mass in solid content conversion of the "resin particle (a1)", the monomer solution (2) is mixed and dispersed for 4 hours with the mechanical disperser "CLEARMIX" (manufactured by M technique Co., Ltd.) including a circulation route to prepare a dispersion liquid including an emulsified particle with the dispersion particle diameter of 350 nm. An initiator aqueous solution in which 2.5 parts by mass of the polymerization initiator "KPS" is dissolved in 110 parts by mass of ion exchange water is added to the dispersion liquid. The above is heated and stirred over 2 hours at 90° C. With this, polymerization (second polymerization) is performed to prepare the dispersion liquid of "resin particle (all)".

Preparing forming of outer layer ("resin particle dispersion liquid (A)")

The initiator aqueous solution in which 2.5 parts by mass of the polymerization initiator "KPS" is dissolved in 110 parts by mass of ion exchange water is added to the above dispersion liquid of the "resin particle (all)", and the following monomer solution (3) is dropped under the temperature condition of 80° C. over 1 hour.

Monomer Solution (3)

styrene 230 parts by mass n-butyl acrylate 100 parts by mass n-octylmercaptan 5.2 parts by mass.

After dropping, the above is heated and stirred over 3 hours, and with this polymerization (third polymerization) is performed. Then, the above is cooled to 28° C. to prepare the "resin particle dispersion liquid (A)" in which the resin particle (A) including the styrene-acrylic type resin is dispersed in the anionic surfactant solution. When the Young's modulus of the dried resin particle dispersion liquid (A) is calculated with the later described method, the value is 11.2 MPa.

<Making Resin Dispersion Liquid [B1] to [B7]>

In the present example, dispersion liquid of the resin particle (B) is prepared. The resin particle (B) is used as the resin (2) particle from the resin (2) which mainly composes the convex portion of the toner mother particle.

Synthesizing Resin [B1]

bispehnol A propylene oxide 2 mol adduct 500 parts by mass terephthalic acid 117 parts by mass fumaric acid 82 parts by mass esterification catalyst (tin octoate) 2 parts by mass The above is put into a reaction container including a nitrogen introducing tube, a dehydrating tube, a stirrer, and a thermocouple, undergoes condensation polymerization for 8 hours at 230° C., and is cooled to obtain resin [B1].

Synthesizing Resin [B2]

bispehnol A propylene oxide 2 mol adduct 500 parts by mass terephthalic acid 117 parts by mass fumaric acid 82 parts by mass esterification catalyst (tin octoate) 2 parts by mass The above are put into a reaction container including a nitrogen introducing tube, a dehydrating tube, a stirrer, and a thermocouple, and undergo condensation polymerization for 8 hours at 230° C. Further, the above undergoes reaction for 1 hour at 8 kPa and then is cooled to 160° C.

The mixture including the following is dropped over 1 hour with a dropping funnel.

acrylic acid 10 parts by mass styrene 6 parts by mass butyl acrylate 1 part by mass polymerization initiator (di-t-butyl peroxide) 10 parts by mass After dropping the mixture, the temperature is maintained at 160° C. and the additional polymerization reaction is continued for 1 hour. Then, the temperature is raised to 200° C., and after holding for 1 hour at 10 kPa, the acrylic acid, styrene, and butyl acrylate are removed to obtain the resin [B2] formed from bonding the vinyl type polymerization segment and the polyester type polymerization segment.

The resin [B3] to resin [B7] are similarly obtained. The composition of each resin is shown in Table 1. The Young's modulus of resin [B1] to resin [B7] is measured by the later described method. The result is shown in Table 1.

TABLE 1

| RESIN | POLY-ALCOHOL MONOMER BISPHENOL A PROPYLENE OXIDE (PARTS BY MASS) | mol | POLYCARBOXYLIC ACID MONOMER SATURATED DICARBOXYLIC ACID TEREPHTHALIC ACID (PARTS BY MASS) | mol | UNSATURATED ALIPHATIC DICARBOXYLIC ACID FUMARIC ACID (PARTS BY MASS) | mol | BOTH REACTIVE MONOMER ACRYLIC ACID (PARTS) BY MASS) | AROMATIC TYPE VINYL MONOMER STYRENE (PARTS) BY MASS) | (METH) ACRYLIC ACID ESTER TYPE MONOMER BUTYL ACRYLATE (PARTS BY MASS) | STYRENE-ACRYLIC CONTENT RATIO (% BY MASS) | YOUNG'S MODULUS (GPa) |
|---|---|---|---|---|---|---|---|---|---|---|---|
| B1 | 500 | 1.45 | 117 | 0.70 | 82 | 0.71 | — | — | — | 0 | 5.1 |
| B2 | 500 | 1.45 | 117 | 0.70 | 82 | 0.71 | 10 | 6 | 1 | 1 | 5.2 |
| B3 | 500 | 1.45 | 117 | 0.70 | 82 | 0.71 | 10 | 30 | 7 | 5 | 5.8 |
| B4 | 500 | 1.45 | 117 | 0.70 | 82 | 0.71 | 10 | 63 | 16 | 10 | 6.3 |
| B5 | 500 | 1.45 | 117 | 0.70 | 82 | 0.71 | 10 | 243 | 61 | 30 | 7.8 |
| B6 | 500 | 1.45 | 117 | 0.70 | 82 | 0.71 | 10 | 316 | 82 | 40 | 8.5 |
| B7 | 500 | 1.45 | 78 | 0.47 | 110 | 0.95 | — | — | — | 0 | 4.7 |

(Preparing Resin Particle Dispersion Liquid [B1] to [B7])

100 parts by mass of the obtained resin [B1] are grinded with a grinding machine "Roundel mill type:RM-1N" (manufactured by Tokuju Corporation), the above is mixed with 638 parts by mass of the sodium lauryl sulfate with a concentration of 0.26% by mass made in advance. While stirring, the above is dispersed by ultrasonic waves for 30 minutes at V-LEVEL, 300 μA using an ultrasonic homogenizer "US-150T" (manufactured by NIHONSEIKI KAISHA LTD.). With this, the "resin particle dispersion liquid [B1]" is made in which the resin particle [B1] with a volumetric basis median diameter ($D_{50}$% diameter) of 200 nm is dispersed.

The resin particle dispersion liquids [B2] to [B7] are made with the similar method.

<Making Colorant Dispersion Liquid (C)>

90 parts by mass of dodecyl sodium sulfate are stirred and dissolved in 1600 parts by mass of ion exchange water. 420 parts by mass of carbon black "Mogul L" (manufactured by Cabot Corporation) are gradually added to the above solution while stirring. Then, dispersion processing using the stirring apparatus "CLEARMIX" (manufactured by M technique Co., Ltd.) is performed to prepare colorant dispersion liquid (1) including dispersed colorant particles. The diameter of the particle of the dispersion liquid measured using the micro track particle size distribution measurement apparatus "UPA-150" (manufactured by Nikkiso Co., Ltd.) is 117 nm.

<Making Toner 1>

(Forming Toner Mother Particle)

The "resin particle dispersion liquid (A)" as the dispersion liquid of the resin (1) particle in the amount of 410 parts by mass in solid content conversion and ion exchange water in the amount of 1600 parts by mass are added in a reaction container attached with a stirring apparatus, temperature sensor, and cooling tube. Then, aqueous sodium hydroxide in the amount of 5 mol/liter is added to adjust the pH to 12.

Then, the "colorant dispersion liquid (C)" in the amount of 35 parts by mass in solid content conversion is put in the above. Next, an aqueous solution in which 75 parts by mass of magnesium chloride is dissolved in 75 parts by mass of ion exchange water is added over 10 minutes at 30° C. while stirring. Then, after leaving as is for 3 minutes, the heating is started. The temperature is raised to 80° C. over 60 minutes and the particle growth reaction is continued while maintaining 80° C. In this state, the particle diameter of the aggregated particle is measured with the "Multisizer 3" (manufactured by Beckman Coulter, Inc.). When the volumetric basis median diameter ($D_{50}$% diameter) becomes 6.5 μm, the "resin particle dispersion liquid (B1)" is put in as the dispersion liquid of the resin (2) particle in the amount of 75 parts by mass in solid content conversion over 30 minutes. When the supernatant of the reaction liquid becomes transparent, an aqueous solution in which 125 parts by mass of sodium chloride are dissolved in the 500 parts by mass of ion exchange water is added and the particle growth is terminated. The pH when the aggregation ends is 6.0 (80° C.) The above is then further heated, 1 mol/liter of hydrochloric acid aqueous solution is added as the pH adjuster in fusing, and the pH in fusing is adjusted to 4 (80° C.). Then, the above is heated and stirred at 90° C. to progress the fusing of the particle. When the average degree of circularity measured using the apparatus for measuring the average degree of circularity of the toner "FPIA-2100" (manufactured by Sysmex Corporation) becomes 0.945, the above is cooled to 30° C. to obtain the "toner mother particle 1 dispersion liquid".

(Cleaning/Drying)

The particle ("toner mother particle 1 dispersion liquid") generated in the step forming the toner mother particle is separated between solid and liquid with the centrifuge, and a wet cake like form of the toner mother particle is formed. The wet cake is cleaned with ion exchange water at 35° C. until electrical conductivity of the filtrate in the centrifuge becomes 5 μS/cm. Then, the above is transferred to the "Flash Jet Dryer" (manufactured by Seishin Enterprise Co., Ltd.) and dried until the moisture amount becomes 0.5% by mass. With this, the "toner mother particle [1]" is made.

(Additive Processing)

The hydrophobic silica (number average primary particle diameter=12 nm) in the amount of 1% by mass and the hydrophobic titania (number average primary particle diameter=20 nm) in the amount of 0.3% by mass are added to the above "toner mother particle [1]" and mixed with the Henschel mixer to make the toner 1.

<Making Toners 2 to 22>

Other than employing the composition as described in table 2 for the "resin (1) particle dispersion liquid", "resin (2) particle dispersion liquid", "pH in fusing", and "pH adjuster in fusing", the toners 2 to 22 are made with a process similar to "toner 1".

TABLE 2

| | TONER | DISPERSION LIQUID OF RESIN (1) PARTICLE | DISPERSION LIQUID OF RESIN (2) PARTICLE | pH IN FUSION | pH ADJUSTER IN FUSION |
|---|---|---|---|---|---|
| EXAMPLE 1 | TONER 1 | A | B1 | 4.0 | 1 mol/L HYDROCHLORIC ACID |
| EXAMPLE 2 | TONER 2 | A | B1 | 4.5 | 1 mol/L HYDROCHLORIC ACID |
| EXAMPLE 3 | TONER 3 | A | B1 | 5.0 | 1 mol/L HYDROCHLORIC ACID |
| EXAMPLE 4 | TONER 4 | A | B2 | 4.1 | 1 mol/L HYDROCHLORIC ACID |
| EXAMPLE 5 | TONER 5 | A | B2 | 5.2 | 1 mol/L HYDROCHLORIC ACID |
| EXAMPLE 6 | TONER 6 | A | B3 | 4.4 | 1 mol/L HYDROCHLORIC ACID |
| EXAMPLE 7 | TONER 7 | A | B3 | 5.5 | 1 mol/L HYDROCHLORIC ACID |
| EXAMPLE 8 | TONER 8 | A | B4 | 4.8 | 1 mol/L HYDROCHLORIC ACID |
| EXAMPLE 9 | TONER 9 | A | B4 | 6.0 | NO |
| EXAMPLE 10 | TONER 10 | A | B5 | 6.0 | NO |
| EXAMPLE 11 | TONER 11 | A | B5 | 6.5 | 5 mol/L SODIUM HYDROXIDE |
| EXAMPLE 12 | TONER 12 | A | B5 | 7.0 | 5 mol/L SODIUM HYDROXIDE |
| EXAMPLE 13 | TONER 13 | A | B6 | 8.0 | 5 mol/L SODIUM HYDROXIDE |
| EXAMPLE 14 | TONER 14 | A | B4 | 4.6 | 1 mol/L HYDROCHLORIC ACID |
| EXAMPLE 15 | TONER 15 | A | B4 | 6.4 | 5 mol/L SODIUM HYDROXIDE |
| COMPARISON EXAMPLE 1 | TONER 16 | A | B5 | 5.7 | 5 mol/L SODIUM HYDROXIDE |
| COMPARISON EXAMPLE 2 | TONER 17 | A | B7 | 4.0 | 1 mol/L HYDROCHLORIC ACID |
| COMPARISON EXAMPLE 3 | TONER 18 | A | B2 | 3.9 | 1 mol/L HYDROCHLORIC ACID |
| COMPARISON EXAMPLE 4 | TONER 19 | A | B2 | 5.4 | 1 mol/L HYDROCHLORIC ACID |
| COMPARISON EXAMPLE 5 | TONER 20 | A | B4 | 4.0 | 1 mol/L HYDROCHLORIC ACID |
| COMPARISON EXAMPLE 6 | TONER 21 | A | — | 6.0 | NO |
| COMPARISON EXAMPLE 7 | TONER 22 | B4 | A | 6.9 | 5 mol/L SODIUM HYDROXIDE |

(Physical Property of Toners 1 to 22)

According to the method below, presence of a convex portion, the average value of the length of the long side of the convex portion, the value of the ratio (ER (1)/ER (2), value of the ratio of the Young's modulus in table 3) between the Young's modulus (ER (1)) of the non-convex portion and the Young's modulus (ER (2)) of the convex portion of the toner mother particle, vinyl segment content ratio of the resin (2) (in the present embodiment, styrene-acrylic content ratio), and the covering percentage of the convex portion are measured for the toners 1 to 22. The result is shown in table 3.

(Measurement of Average Value of Length of Long Side of Convex Portion)

The convex portion 2 and the non-convex portion 3 are confirmed by sight with the SEM image data of observation at 10000 times with the scanning electron microscope (SEM). The outline is drawn for each convex portion 2 (see FIG. 2), and when the outline is between two parallel lines, the portion where the distance between the two parallel lines becomes largest is to be the long side of the convex portion 2. 100 convex portions 2 with the length of the long side of the convex portion 2 being 50 nm or more are measured, and the average value is to be the average value of the length of the long side of the convex portion 2.

(Value of Ratio of Young's Modulus)

Measurement of the Young's modulus is performed by nanoindentation method.

The Young's modulus Er measured by the nanoindentation method is measured by using the nanoindenter, specifically "Triboscope and SII NanoNavi II" (manufactured by Hysitron Corporation). Specifically, the load of the probe is changed from 0.1 μN to 30 μN for each 0.3 μN, and the measurement data is collected until the pressed depth of the probe exceeds 100 nm. The Young's modulus Er of the most outer surface portion is calculated from the load curve when the probe is pressed to 100 nm.

The positions of the convex portion and the portion other than the convex portion (non-convex portion) on the surface of the toner mother particle are confirmed by sight with the scanning probe microscope. The measurement of the nonconvex portion and the convex portion of the toner mother particle are performed separately. The measurement conditions are as described below.

Measurement Indenter: diamond Berkovich indenter with an equilateral triangle shaped tip Measurement Environment: 20° C., 60% RH Measurement Sample: commercially available Araldite (epoxy which is a 12-hour hardening type) on a glass slide The adhesive is thinly applied, and after hardening at room temperature for 1.5 hours, the toner is sprinkled and further hardened. In a state where the bottom portion of the toner particle is fixed to the adhesive, the exposed portion of the surface is measured. The measurement is performed by measuring randomly selected 10 points for each sample, and the average value is to be the Young's modulus measured by the nanoindentation method. The Young's modulus (ER (1)) of the non-convex portion and the Young's modulus (ER (2)) of the convex portion in the toner mother particle are measured separately and the value of the ratio (ER (1)/ER (2)) of the Young's modulus is calculated.

(Measurement of Whether there is Convex Portion and Covering Percentage)

The toner mother particle is observed with the scanning electron microscope (SEM).

The obtained SEM image is used to confirm by sight whether or not there is the convex portion.

Moreover, the covering percentage of the convex portion with respect to the certain surface area of the toner mother particle is calculated from the obtained SEM image.

1. The shortest length of two parallel lines in contact with the toner mother particle is obtained, and each contact point is to be A and B.

2. The covering percentage of the convex portion with respect to the toner mother particle is calculated from the area of the circle with the middle point O of the line AB as the center and the length of the line AO as the diameter and the area of the convex portion included in the circle.

3. The covering percentage is calculated with the above method for the 100 or more toner particles, the average value is obtained, and this is to be the covering percentage of the convex portion.

(Evaluation Method)

<Suppressing of Filming>

An image forming apparatus "bizhub PRO C6500" (manufactured by KONICA MINOLTA, INC.) is used to form images 1,000,000 times successively under an environment of high temperature and high humidity (temperature 33° C., relative humidity 80%). The density unevenness of the obtained image, in other words, the image density unevenness due to toner filming on the photoreceptor is confirmed by sight. When the image density unevenness cannot be seen even after the number of successive printed sheets reaches 1,000,000 sheets, this is evaluated as "Excellent". When the image density unevenness can be slightly seen up to when the number of successive printed sheets reaches 1,000,000 sheets, but the image density unevenness cannot be seen up to 700,000 sheets, this is evaluated as "Good". When the image density unevenness can be slightly seen up to when the number of successive printed sheets reaches 700,000 sheets, but the image density unevenness cannot be seen up to 500,000 sheets, this is evaluated as "Fair" and that there is no problem in practical use. When the image density unevenness can be seen up to when the number of successive printed sheets reaches 500,000, this is evaluated as "Poor".

<Low Temperature Fixing Performance>

Image evaluation is performed by successively loading the developer made as described above in the developing apparatus of the commercially available color copier "bizhub PRO C6500" (manufactured by KONICA MINOLTA, INC.). The apparatus is modified so that the fixing temperature, the toner attaching amount and the system speed can be set freely. NPi high quality paper 128 g/m$^2$ (manufactured by Nippon Paper Industries Co., Ltd.) is used as the evaluation sheet. A solid image is fixed with the following conditions, the toner attaching amount is 11.3 g/m$^2$, the fixing speed is 300 mm/sec, the temperature of the fixing upper belt is set within the range of 150 to 200° C. and the temperature of the fixing lower roller is set 20° C. lower than the upper belt. The image is fixed at a temperature set in a unit of 5° C. With the above conditions, the lower limit fixing temperature where the cold offset does not occur is evaluated. The lower the lower limit fixing temperature is, the fixing performance is considered to be higher.

(Determining Standard)

Excellent: lower limit fixing temperature is less than 150° C.

Good: lower limit fixing temperature is 150° C. or more and less than 165° C.

Poor: lower limit fixing temperature is 165° C. or more

<Toner Fluidity>

Bulk density is obtained as an index of fluidity using the bulk density measuring apparatus of the Kawakita method (IH2000 type).

Specifically, the method of measuring the bulk density is as follows.

Toner before image evaluation is used. The toner is placed on the sieve with 120 mesh and after dropping for 90 seconds at a vibration strength of 6, the vibration is stopped and left as is for 30 seconds. Then, the level bulk density (toner mass/volume) is obtained.

As the bulk density becomes large, the fluidity becomes preferable, and the handling and the transfer performance in the copier is enhanced.

(Evaluation Standard)

Excellent: 0.380 or more (Excellent)

Good: 0.360 or more and less than 0.380 (Practical use possible)

Fair: 0.340 or more and less than 0.360 (Practical use possible)

Poor: 0.340 or less (Practical use not possible)

Transfer defect occur under high temperature and high humidity.

TABLE 3

| | TONER | PRESENCE OF CONVEX PORTION | *1 (μM) | YOUNG'S MODULUS OF CONVEX PORTION (GPa) | YOUNG'S MODULUS OF NON-CONVEX PORTION (GPa) | VALUE OF RATIO OF YOUNG'S MODULUS | *2 (%) | COVERING PERCENTAGE OF CONVEX PORTION (%) | SUPPRESSING FILMING | LOW TEMPERATURE FIXING PERFORMANCE | TONER FLUIDITY |
|---|---|---|---|---|---|---|---|---|---|---|---|
| EXAMPLE 1 | TONER 1 | YES | 0.13 | 5.1 | 9.2 | 1.8 | 0 | 6 | FAIR | GOOD | EXCELLENT |
| EXAMPLE 2 | TONER 2 | YES | 0.24 | 5.1 | 9.7 | 1.9 | 0 | 16 | FAIR | EXCELLENT | EXCELLENT |
| EXAMPLE 3 | TONER 3 | YES | 0.47 | 5.1 | 10.2 | 2.0 | 0 | 25 | FAIR | EXCELLENT | GOOD |
| EXAMPLE 4 | TONER 4 | YES | 0.11 | 5.2 | 9.4 | 1.8 | 1 | 8 | GOOD | GOOD | EXCELLENT |
| EXAMPLE 5 | TONER 5 | YES | 0.48 | 5.2 | 9.9 | 1.9 | 1 | 24 | GOOD | EXCELLENT | GOOD |
| EXAMPLE 6 | TONER 6 | YES | 0.12 | 5.8 | 9.9 | 1.7 | 5 | 6 | EXCELLENT | EXCELLENT | EXCELLENT |
| EXAMPLE 7 | TONER 7 | YES | 0.47 | 5.8 | 10.4 | 1.8 | 5 | 25 | EXCELLENT | EXCELLENT | GOOD |
| EXAMPLE 8 | TONER 8 | YES | 0.10 | 6.3 | 10.1 | 1.6 | 10 | 6 | GOOD | EXCELLENT | EXCELLENT |
| EXAMPLE 9 | TONER 9 | YES | 0.46 | 6.3 | 10.1 | 1.6 | 10 | 24 | EXCELLENT | EXCELLENT | GOOD |
| EXAMPLE 10 | TONER 10 | YES | 0.15 | 7.8 | 9.4 | 1.2 | 30 | 8 | EXCELLENT | GOOD | EXCELLENT |
| EXAMPLE 11 | TONER 11 | YES | 0.25 | 7.8 | 10.1 | 1.3 | 30 | 15 | EXCELLENT | EXCELLENT | EXCELLENT |
| EXAMPLE 12 | TONER 12 | YES | 0.48 | 7.8 | 10.1 | 1.3 | 30 | 24 | EXCELLENT | EXCELLENT | GOOD |
| EXAMPLE 13 | TONER 13 | YES | 0.22 | 8.5 | 10.2 | 1.2 | 40 | 22 | EXCELLENT | GOOD | GOOD |
| EXAMPLE 14 | TONER 14 | YES | 0.10 | 6.3 | 9.5 | 1.5 | 10 | 3 | GOOD | GOOD | EXCELLENT |
| EXAMPLE 15 | TONER 15 | YES | 0.50 | 6.3 | 10.7 | 1.7 | 10 | 28 | EXCELLENT | EXCELLENT | FAIR |
| COMPARISON EXAMPLE 1 | TONER 16 | YES | 0.10 | 7.8 | 8.6 | 1.1 | 30 | 5 | POOR | GOOD | EXCELLENT |
| COMPARISON EXAMPLE 2 | TONER 17 | YES | 0.41 | 4.7 | 10.3 | 2.2 | — | 23 | POOR | GOOD | POOR |
| COMPARISON EXAMPLE 3 | TONER 18 | YES | 0.08 | 5.2 | 9.4 | 1.8 | 1 | 4 | POOR | GOOD | EXCELLENT |
| COMPARISON EXAMPLE 4 | TONER 19 | YES | 0.55 | 5.2 | 9.9 | 1.9 | 1 | 32 | FAIR | GOOD | POOR |

TABLE 3-continued

| | TONER | PRESENCE OF CONVEX PORTION | *1 (μM) | YOUNG'S MODULUS OF CONVEX PORTION (GPa) | YOUNG'S MODULUS OF NON-CONVEX PORTION (GPa) | VALUE OF RATIO OF YOUNG'S MODULUS | *2 (%) | COVERING PERCENTAGE OF CONVEX PORTION (%) | SUPPRESSING FILMING | LOW TEMPERATURE FIXING PERFORMANCE | TONER FLUIDITY |
|---|---|---|---|---|---|---|---|---|---|---|---|
| COMPARISON EXAMPLE 5 | TONER 20 | YES | — | — | — | — | 10 | 0 | POOR | GOOD | EXCELLENT |
| COMPARISON EXAMPLE 6 | TONER 21 | YES | — | — | — | — | — | 0 | POOR | POOR | EXCELLENT |
| COMPARISON EXAMPLE 7 | TONER 22 | YES | 0.32 | 11.2 | 6.7 | 0.6 | — | 43 | POOR | POOR | POOR |

*1: AVERAGE VALUE OFLENGTH OF LONG SIDE OF CONVEX PORTION
*2: CONTENT RATIO OF VINYL TYPE POLYMERIZATION SEGMENT OF RESIN (2)

CONCLUSION

As it is clear from the above result, compared to the comparison example toners 16 to 22, the toners 1 to 15 of the present invention is able to suppress filming and maintain fluidity while maintaining low temperature fusing performance.

Specifically, the following observations are made regarding the comparison examples 1 to 7.

In the comparison example 1, it is assumed that since the value of the ratio of the Young's modulus is less than 1.2 (the Young's modulus of the convex portion is high) due to the compatibility between the convex portion and the non-convex portion progressing, the convex portion is buried in the toner mother particle due to mechanical stress in the developing apparatus, and filming occurred.

In the comparison example 2, it is assumed that since the value of the ratio of the Young's modulus is larger than 2.0 (the Young's modulus of the convex portion is low) due to the percentage of the fumaric acid with flexibility being increased as the monomer composing the resin of the convex portion, the convex portion is crushed on the toner mother particle due to mechanical stress in the developing apparatus or the convex portion is separated due to the compatibility with the non-convex portion being bad, and the filming occurred.

In the comparison example 3, it is assumed that since the average value of the length of the long side of the convex portion is smaller than 0.1 μm due to the compatibility between the convex portion and the non-convex portion progressing, the effect of the shape of the convex portion could not be achieved and the filming occurred.

In the comparison example 4, it is assumed that since the average value of the length of the long side of the convex portion is larger than 0.5 μm due to the compatibility between the convex portion and the non-convex portion not progressing, the fluidity worsened.

In the comparison example 5, it is assumed that since the toner mother particle and the convex portion are completely compatible and the convex portion is not formed, the effect of the shape of the convex portion could not be achieved and the filming occurred.

In the comparison example 6, it is assumed that since the resin (2) is not included, the low temperature fixing performance worsened, and since the convex portion is not formed, the effect of the shape of the convex portion could not be achieved and with this, the filming occurred.

In the comparison example 7, filming occurred due to reasons similar to the comparison example 1. Further, since the vinyl modified polyester resin included in the non-convex portion does not come into contact with medium such as paper, the low temperature fixing performance worsens and the fluidity worsens due to the covering percentage of the convex portion being high.

Although various exemplary embodiments have been shown and described, the invention is not limited to the embodiments shown. Therefore, the scope of the invention is intended to be limited solely by the scope of the claims that follow and its equivalents.

The entire disclosure of Japanese Patent Application No. 2013-184901 filed on Sep. 6, 2013 including description, claims, drawings, and abstract are incorporated herein by reference in its entirety.

What is claimed is:

1. A toner for developing an electrostatic latent image comprising:

a toner mother particle; and a convex portion on a surface of the toner mother particle, wherein, (a) the toner mother particle includes at least a resin (1);

(b) the convex portion is formed from a resin particle including at least a resin (2);

(c) an average value of a length of a long side of the convex portion is within a range of 0.1 to 0.5 μm; and (d) a ratio between a Young's modulus of a non-convex portion of the toner mother particle (ER (1)) and a Young's modulus of a convex portion of the toner mother particle (ER (2)) is a value (ER (1)/ER (2)) within the range of 1.2 to 2.0.

2. The toner for developing an electrostatic latent image of claim 1, wherein the resin (2) is a resin including at least polyester resin.

3. The toner for developing an electrostatic latent image of claim 1, wherein the resin (2) is a resin formed from bonding a vinyl type polymerization segment and a polyester type polymerization segment.

4. The toner for developing an electrostatic latent image of claim 3, wherein a content ratio of the vinyl type polymerization segment in the resin (2) with respect to a total mass of the resin formed from bonding the vinyl type polymerization segment and the polyester type polymerization segment is within a range of 1 to 30% by mass.

5. The toner for developing an electrostatic latent image of claim 3, wherein a content ratio of the vinyl type polymerization segment in the resin (2) with respect to a total mass of the resin formed from bonding the vinyl type polymerization segment and the polyester type polymerization segment is within a range of 5 to 10% by mass.

6. The toner for developing an electrostatic latent image of claim 1, wherein a covering percentage of the convex portion with respect to a certain surface area of the toner mother particle is within a range of 5 to 25%.

7. The toner for developing an electrostatic latent image of claim 1, wherein a covering percentage of the convex portion with respect to a certain surface area of the toner mother particle is within a range of 10 to 20%.

8. The toner for developing an electrostatic latent image of claim 1, wherein the resin (1) is a resin including at least styrene-acrylic type resin.

9. The toner for developing an electrostatic latent image of claim 1, wherein an average particle diameter of the resin particle including at least the resin (2) is within a range of 50 to 500 nm.

10. A manufacturing method of the toner for developing an electrostatic latent image of claim 1, the method including at least the following:

(1): preparing a dispersion liquid of a resin (1) particle formed from the resin (1);

(2): preparing a dispersion liquid of a resin (2) particle formed from the resin (2);

(3): forming a toner mother particle precursor by aggregating the resin (1) particle included in the dispersion liquid of the resin (1) particle; and (4): forming a toner mother particle by fusing the resin (2) particle with the toner mother particle precursor in an aqueous medium.

11. The manufacturing method of the toner for developing an electrostatic latent image of claim 10, wherein (4) includes adjusting pH of the aqueous medium with a pH adjuster after attaching the resin (2) to the toner mother particle precursor.

12. The manufacturing method of the toner for developing an electrostatic latent image of claim 11, wherein the pH of the aqueous medium is within a range of 4 to 7 when measured at a liquid temperature of 80° C. in (4).

* * * * *